US008592112B2

(12) United States Patent
Yoshida et al.

(10) Patent No.: US 8,592,112 B2
(45) Date of Patent: Nov. 26, 2013

(54) ORANGE TONER AND TONER CARTRIDGE FOR STORING THE SAME, ORANGE DEVELOPER AND PROCESS CARTRIDGE FOR STORING THE SAME, COLOR TONER SET, AND IMAGE FORMING APPARATUS

(75) Inventors: Satoshi Yoshida, Kanagawa (JP); Akira Matsumoto, Kanagawa (JP); Masanobu Ninomiya, Kanagawa (JP); Yusuke Ikeda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 271 days.

(21) Appl. No.: 13/072,061

(22) Filed: Mar. 25, 2011

(65) Prior Publication Data

US 2012/0077119 A1 Mar. 29, 2012

(30) Foreign Application Priority Data

Sep. 27, 2010 (JP) ..... 2010-215378

(51) Int. Cl.
*G03G 9/09* (2006.01)

(52) U.S. Cl.
USPC ..... 430/107.1; 430/109.4; 430/108.8; 430/45.4; 430/108.23

(58) Field of Classification Search
USPC ..... 430/107.1, 109.4, 108.8, 45.4, 108.23
See application file for complete search history.

(56) References Cited

U.S. PATENT DOCUMENTS

| | | | | |
|---|---|---|---|---|
| 5,346,792 | A * | 9/1994 | Kobayashi et al. | 430/109.4 |
| 5,866,288 | A * | 2/1999 | Ciccarelli et al. | 430/45.4 |
| 7,723,002 | B2 * | 5/2010 | Shimokusa et al. | 430/108.8 |
| 7,781,135 | B2 * | 8/2010 | Asarese et al. | 430/108.1 |
| 2004/0185355 | A1 | 9/2004 | Sato et al. | |
| 2009/0162762 | A1 | 6/2009 | Maehata et al. | |
| 2009/0286176 | A1 * | 11/2009 | Ohmura et al. | 430/107.1 |

FOREIGN PATENT DOCUMENTS

| | | |
|---|---|---|
| EP | 1 253 475 A2 | 10/2002 |
| JP | A 61-118759 | 6/1986 |
| JP | A 2002-156776 | 5/2002 |
| JP | A 2005-055495 | 3/2005 |
| JP | A 2007-304401 | 11/2007 |
| JP | A 2008-003274 | 1/2008 |
| JP | A 2008-158151 | 7/2008 |

OTHER PUBLICATIONS

English language machine translation of JP 2002-156776 (May 2002).*
European Search Report dated Dec. 22, 2011 issued in European Patent Application No. 11160180.3.

* cited by examiner

*Primary Examiner* — Christopher Rodee
(74) *Attorney, Agent, or Firm* — Oliff & Berridge, PLC

(57) ABSTRACT

An orange toner including a binder resin containing a polyester resin having a dodecenyl succinic acid structure as a constituent unit; and C.I. Pigment Orange 38 in a blending amount of from 5% by mass to 18% by mass relative to the whole mass of the toner and a toner storage container for storing the same, an orange developer and a process cartridge for storing the same, a color toner set, and an image forming apparatus.

13 Claims, 2 Drawing Sheets

ORANGE TONER AND TONER CARTRIDGE FOR STORING THE SAME, ORANGE DEVELOPER AND PROCESS CARTRIDGE FOR STORING THE SAME, COLOR TONER SET, AND IMAGE FORMING APPARATUS

CROSS-REFERENCE TO RELATED APPLICATIONS

This application is based on and claims priority under 35 USC 119 from Japanese Patent Application No. 2010-215378 filed on Sep. 27, 2010.

BACKGROUND

1. Technical Field

The present invention relates to an orange toner and a toner cartridge for storing the same, to an orange developer and a process cartridge for storing the same, to a color toner set, and to an image forming apparatus.

2. Related Art

At present, a method for visualizing (developing) image information through an electrostatic charge image, such as electrophotography, is utilized in various fields. In the electrophotography, for example, the visualization is performed by forming an electrostatic latent image on an electrostatic latent image holding member by a charge and exposure step (electrostatic latent image forming step), supplying a toner thereto to develop the electrostatic latent image (developing step), transferring the developed toner image onto a recording medium through or not through an intermediate transfer member (transfer step) and fixing the transferred imager (fixing step).

In the electrophotography, in the case of forming a full color image, in general, the color reproduction is performed using toners of three colors of a combination of yellow, magenta and cyan as three primary colors of a color material, or four colors further adding black thereto. In that case, a secondary color, for example, a red image is formed by stacking a yellow toner and a magenta toner in an appropriate proportion.

SUMMARY

According to an aspect of the invention, there is provided an orange toner comprising a binder resin and a coloring agent, wherein the binder resin contains a polyester resin having a dodecenyl succinic acid structure; and the coloring agent contains C.I. Pigment Orange 38 in a content of from about 5% by mass to about 18% by mass relative to the whole mass of the toner.

DETAILED DESCRIPTION

[Orange Toner]

Figure 1:
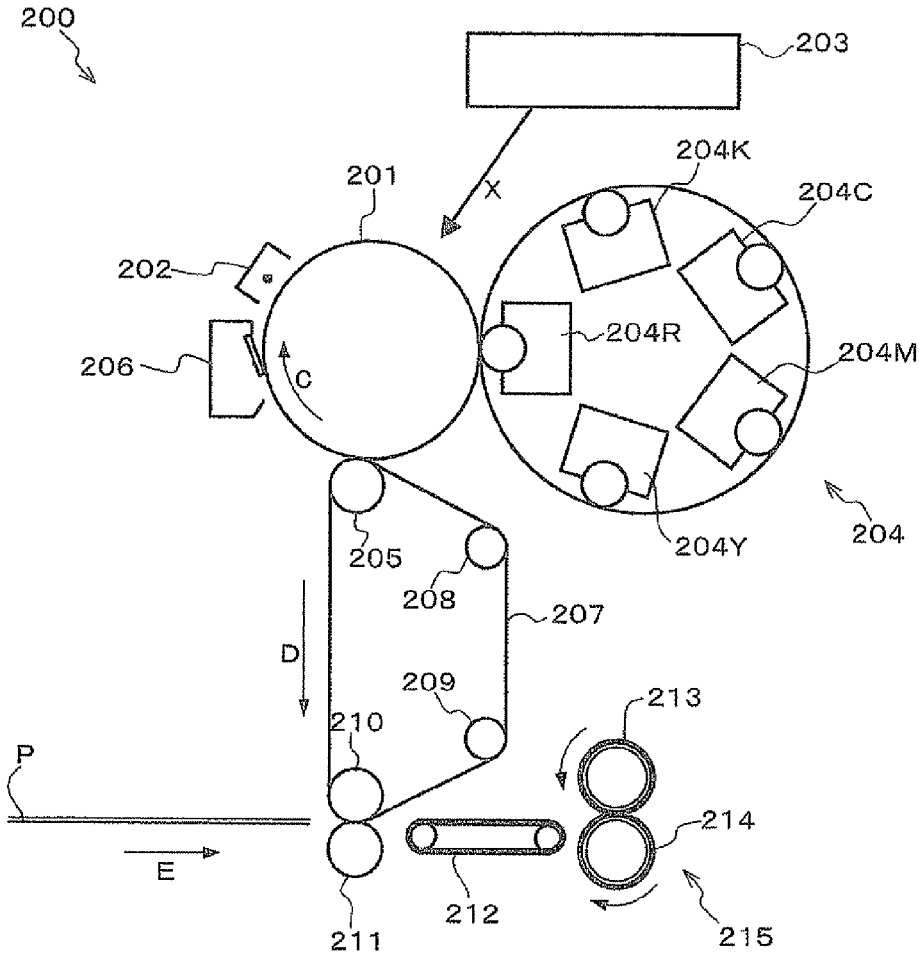
FIG. 1 is a diagrammatic configuration view showing an image forming apparatus of an exemplary embodiment that is an example of the invention.

An orange toner of the present exemplary embodiment contains a binder resin containing a polyester resin having a dodecenyl succinic acid structure as a constituent unit; and further contains therein C.I. Pigment Orange 38 as a coloring agent in a blending amount of from 5% by mass to 18% by mass or from about 5% by mass to about 18% by mass, relative to the whole mass of the toner. The orange toner of the present exemplary embodiment is preferably an orange toner that is prepared in an aqueous medium.

As for the orange toner of the invention, first of all, every component of a so-called toner particle exclusive of an external additive is described in detail, and its manufacturing method, a toner having an external additive added thereto (hereinafter sometimes referred to simply as an "externally added toner") and physical properties of from the toner particle to the externally added toner are mentioned.

<Coloring Agent>

In the orange toner according to the present exemplary embodiment, it is one of characteristic features to use C.I. (Color Index) Pigment Orange 38 as a coloring agent. C.I. Pigment Orange 38 is good in color developing properties and suitable as a pigment of a red toner from the standpoint of color tint. However, since C.I. Pigment Orange 38 is not too good in compatibility with polyester resins, it is easy to aggregate during the manufacture.

In the case of manufacturing a toner in a state where a pigment aggregates, the pigment is easily exposed on the toner surface, and in particular, an electrification increase is easily caused in a low-humidity environment. Changes in charge characteristics on the basis of changes in the humidity simultaneously bring about changes in image density. That is, when a toner made of a polyester resin as a binder resin is manufactured using C.I. Pigment Orange 38 as the coloring agent, environmental dependency of the image density (the image density changes depending upon the humidity) is easy to become high.

In the present exemplary embodiment, by using, as a binder resin, a polyester resin having a dodecenyl succinic acid structure as a constituent unit, the compatibility of C.I. Pigment Orange 38 is improved to make it hard to cause aggregation, thereby suppressing the environmental dependency of chargeability of the toner.

In the orange toner according to the present exemplary embodiment, in addition to C.I. Pigment Orange 38, other pigment or dye, an extender pigment or the like may be mixed and used in the coloring agent depending upon the purpose. A proportion of C.I. Pigment Orange 38 is preferably 60% by mass or more, and more preferably 80% by mass or more on the basis of the whole of the coloring agent, and it is the most preferable that the whole of the coloring agent is occupied by C.I. Pigment Orange 38. When the proportion of C.I. Pigment Orange 38 falls within the foregoing ranges, even in the case of mixing two or more kinds of a coloring agent, the color does not become cloudy, and profits of excellent color developing properties of C.I. Pigment Orange 38 can be enjoyed.

Examples of the pigment which can be mixed and used include general pigments of yellow, orange, red, magenta and so on. Examples of the extender pigment which can be used include a barite powder, barium carbonate, clay, silica, white carbon, talc and alumina white. However, since the extender pigment often deteriorates transparency, it is not preferable to mix and use the extender pigment.

Also, examples of the dye which can be mixed and used include various dyes such as basic, acidic, disperse or direct dyes, for example, Nigrosine, Methylene Blue, Rose Bengal, Quinoline Yellow, Ultramarine Blue, etc. Also, these dyes may be used singly or mixed, and may also be used in a state of a solid solution. When used in a wet manufacturing method, from the viewpoint of suppressing the dye from coining out into an aqueous phase, an oil-soluble dye is preferable. Also, it is preferable to use the dye after subjecting the dye to a treatment such as chemical hydrophobization and encapsulation with a polymer.

A blending amount of C.I. Pigment Orange 38 in the orange toner according to the present exemplary embodiment is preferably in the range of from 5% by mass to 18% by mass or from about 5% by mass to about 18% by mass, more preferably in the range of from 6% by mass to 15% by mass or from about 6% by mass to about 15% by mass, and still more preferably in the range of from 7% by mass to 12% by mass or from about 7% by mass to about 12% by mass, relative to the whole amount of the toner (the whole amount refers to a mass of the so-called toner particle exclusive of the external additive; hereinafter the same in the case of referring to "whole amount of the toner"). When the blending amount of C.I. Pigment Orange 38 is 5% by mass or more or about 5% by mass or more, sufficient color development is obtainable. Also, when the blending amount of C.I. Pigment Orange 38 is 18% by mass or less or about 18% by mass or less, there is no occurrence of the matter that the colors become excessively deep in a low image density area due to an excessively high concentration.

A dispersion diameter of the coloring agent in the orange toner according to the present exemplary embodiment is preferably in the range of from 30 nm to 300 nm or from about 30 nm to about 300 nm, and more preferably in the range of from 60 nm to 200 nm or from about 60 nm to about 200 nm. When the dispersion diameter of the pigment is 30 nm or more or about 30 nm or more, the toner does not become remarkably thick in viscosity. Also, when the dispersion diameter of the pigment is 300 nm or less or about 300 nm or less, since the pigment is not exposed on the toner surface, there is no lowering in a charge quantity of the toner.

<Binder Resin>

The orange toner according to the present exemplary embodiment includes, as a binder resin, a polyester resin containing a dodecenyl succinic acid structure as a constituent unit.

(Dodecenyl Succinic Acid Structure)

The "dodecenyl succinic acid structure" as referred to herein is a constituent unit in a state where hydrogens of two carboxyl groups in dodecenyl succinic acid come off, and it is represented by the following structural formula.

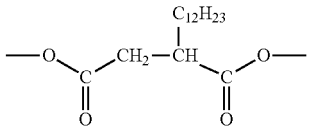

A functional group represented by $C_{12}H_{23}$ is a dodecenyl group and contains one carbon-carbon double bond in a linear structure having a carbon number of 12. A position of the subject double bond is not specified, and any position is adopted.

The dodecenyl succinic acid structure is existent as a copolymerization unit in a state where it is incorporated into a structure of a polyester resin as described later. A copolymerization proportion is preferably in the range of from 3 mol % to 30 mol % or from about 3 mol % to about 30 mol %, more preferably in the range of from 5 mol % to 25 mol % or from about 5 mol % to about 25 mol %, and still more preferably in the range of from 7 mol % to 20 mol % or from about 7 mol % to about 20 mol %, based on 100 mol % of the whole of acid-derived components of the polyester resin. When the copolymerization proportion is 3 mol % or more or about 3 mol % or more, dispersibility of the coloring agent becomes good. Also, when the copolymerization proportion is 30 mol % or less or about 30 mol % or less, coloration of the resin into a dark reddish-brown color is prevented from occurring.

The dodecenyl succinic acid structure may be incorporated into the structure of the polyester resin by making dodecenyl succinic acid or an anhydride thereof present together with a synthesis raw material of the polyester resin and copolymerizing them at the synthesis of the polyester resin.

In the orange toner according to the present exemplary embodiment, a ratio of mol % of the dodecenyl succinic acid structure in the toner to the content (mass %) of C.I. Pigment Orange 38 in the toner is preferably in the range of from 3/1 to 1/12 or from about 3/1 to about 1/12, more preferably in the range of from 2/1 to 1/9 or from about 2/1 to about 1/9.

(Polyester Resin)

It is preferable that the binder resin of the orange toner according to the present exemplary embodiment is composed of a polyester resin containing a dodecenyl succinic acid structure mainly or entirely as a constituent unit (hereinafter sometimes referred to simply as a "specified polyester resin"). A blending proportion of the specified polyester resin in the whole of the binder resin is preferably 60% by mass or more, and more preferably 80% by mass or more, and it is still more preferable that the whole of the binder resin is occupied by the specified polyester resin. When the blending proportion of the specified polyester resin falls within the foregoing ranges, properties inherent to the polyester resin can be enjoyed.

Examples of a resin other than the polyester resin, which can be used as the binder resin, include amorphous resins such as homopolymers or copolymers of monoolefins (for example, ethylene, propylene, butylene, isoprene, etc.); vinyl esters (for example, vinyl acetate, vinyl propionate, vinyl benzoate, vinyl butyrate, etc.); α-methylene aliphatic monocarboxylic acid esters (for example, methyl acrylate, phenyl acrylate, octyl acrylate, methyl methacrylate, ethyl methacrylate, butyl methacrylate, dodecyl methacrylate, etc.); vinyl ethers (for example, vinyl methyl ether, vinyl ethyl ether, vinyl butyl ether, etc.); vinyl ketones (for example, vinyl methyl ketone, vinyl hexyl ketone, vinyl isopropenyl ketone, etc.); or the like. In particular, examples of typical binder resins of these resins include polystyrene, a styrene-alkyl acrylate copolymer, a styrene-butadiene copolymer, a styrene-maleic anhydride copolymer, polyethylene and polypropylene. Furthermore, polyurethane, an epoxy resin, a silicone resin, a polyamide, a modified rosin and so on are exemplified.

Also, it is preferable that the binder resin includes a crystalline resin having crystallinity. The binder resin may include a crystalline resin and the foregoing amorphous resin. It is preferable that the binder resin is a binder resin containing the amorphous specified polyester resin and the crystalline resin.

The amorphous polyester resin which is used in the invention means a polyester resin which in the differential scanning calorimetry (DSC), does not reveal an endothermic peak corresponding to a crystal melting temperature, in addition to a stepwise endothermic point corresponding to the glass transition.

Known polyester resins can be used as the amorphous polyester resin. The amorphous polyester resin is synthesized from a polyvalent carboxylic acid component and a polyhydric alcohol component. In this connection, as the amorphous polyester resin, commercially available products may be used, or synthesized materials may be used. Also, as for the amorphous polyester resin, though a single kind of amorphous polyester resin may be used, a mixture of two or more kinds of polyester resins may be used.

The polyvalent carboxylic acid and the polyhydric alcohol which are used for the amorphous polyester resin are not particularly limited and are monomers described in, for example, *Kobunshi Deta Handobukku: Kiso-Hen* (Polymer Data Handbook, Fundamental Edition) (edited by The Society of Polymer Science, Japan and published by Baifukan Co., Ltd.). Examples thereof include conventionally known divalent or trivalent or more polyvalent carboxylic acids and dihydric or trihydric or more polyhydric alcohols.

As for specific examples of these monomer components, examples of the divalent carboxylic acid include dibasic acids such as succinic acid, alkyl succinates, alkenyl succinates, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic carboxylic acid, cyclohexanedicarboxylic acid, cyclohexanedicarboxylic acid, malonic acid and mesaconic acid, and anhydrides or lower alkyl esters thereof; and aliphatic unsaturated dicarboxylic acids such as maleic acid, fumaric acid, itaconic acid and citraconic acid. Of these compounds, a material containing 30 mol % or more of terephthalic acid in the acid component is preferable from the standpoint of a balance between a glass transition temperature of the polyester resin and flexibility of the molecule.

Examples of the trivalent or more polyvalent carboxylic acid include 1,2,4-benzenetricarboxylic acid, 1,2,5-benzenetricarboxylic acid and 1,2,4-naphthalenetricarboxylic acid, and anhydrides or lower alkyl esters thereof. These materials may be used singly or in combinations of two or more kinds thereof.

As for the polyhydric alcohol, examples of the divalent alcohol include bisphenol derivatives such as hydrogenated bisphenol A and an ethylene oxide or propylene oxide adduct of bisphenol A; cyclic aliphatic alcohols such as 1,4-cyclohexanediol and 1,4-cyclohexanedimethanol; linear dials such as ethylene glycol, diethylene glycol, propylene glycol, dipropylene glycol, 1,4-butanediol, 1,5-pentanedial and 1,6-hexanediol; and branched dials such as 1,2-propanediol, 1,3-butanediol, neopentyl glycol and 2,2-diethyl-1,3-propanediol. From the viewpoints of chargeability and intensity, an ethylene oxide or propylene oxide adduct of bisphenol A is suitably used.

Also, examples of the trihydric or more polyhydric alcohol include glycerin, trimethylolethane, trimethylolpropane and pentaerythritol. From the viewpoints of low-temperature fixability and image gloss, it is desirable that the use amount of the trivalent or more polyvalent crosslinking monomer is 10 mol % or less of the total amount of the monomers. These materials may be used singly or in combinations of two or more kinds thereof.

In this connection, if desired, for the purposes of adjusting an acid value or a hydroxyl value, and so on, a monovalent acid such as acetic acid and benzoic acid; or a monohydric alcohol such as cyclohexanol and benzyl alcohol can also be used.

Of these, for the purpose of enhancing the compatibility with the crystalline polyester resin, it is preferable to use the monomer component containing from 2 to 30 mol % of a monomer having a long-chain alkyl side chain (the carbon number of the side chain is 4 or more), such as 1,2-hexanediol, alkyl succinates and alkenyl succinates, and anhydrides thereof. Above all, it is preferable that the monomer component contains an alkyl succinate or an alkenyl succinate or an anhydride thereof having high hydrophobicity.

Examples of the alkyl succinate or alkenyl succinate or anhydride thereof include n-butyl succinate, n-butenyl succinate, isobutyl succinate, isobutenyl succinate, n-octyl succinate, n-octenyl succinate, n-dodecyl succinate, n-dodecenyl succinate, isododecyl succinate and isododecenyl succinate, and anhydrides or lower alkyl esters thereof.

In order to satisfy suitable characteristics as the resin, it is desirable that the carbon number of the alkyl group or alkenyl group of the alkyl succinate or alkenyl succinate or anhydride thereof is larger than the carbon number of the constituent monomer which is used for an aliphatic crystalline polyester resin as described later. Also, of these, n-dodecenyl succinate or an anhydride thereof is the most suitable from the standpoints of compatibility with the aliphatic crystalline polyester resin and easiness of the adjustment of a glass transition temperature of the amorphous polyester resin.

The amorphous polyester resin can be synthesized through an arbitrary combination among the foregoing monomer components by adopting a conventionally known method described in, for example, *Jushukugo* (Polycondensation) (published by Kagaku-Dojin Publishing Company, Inc.); *Kobunshi Jikken-Gaku* (Polymer Experimentology), "Polycondensation and Polyaddition" (published by Kyoritsu Shuppan Co., Ltd.); and *Poriesuteru Jushi Handobukku* (Polyester Resin Handbook) (edited by The Nikkan Kogyo Shimbun, Ltd.), and an ester interchange method, a direct polycondensation method or the like, singly or in combinations.

Specifically, the synthesis can be performed at a polymerization temperature of from 140° C. to 270° C., and if desired, the reaction is performed by evacuating the inside of the reaction system while removing water or an alcohol generated at the condensation. When the monomer is not dissolved or compatibilized at the reaction temperature, the monomer may be dissolved upon being added with a high-boiling solvent as a dissolution assisting solvent. It is preferable to perform the polycondensation reaction while distilling off the dissolution assisting solvent. When a monomer with poor compatibility is existent in the copolymerization reaction, it would be better to condense the monomer with poor compatibility and an acid or alcohol scheduled to be polycondensed together with the subject monomer in advance, followed by polycondensation with the main component. A molar ratio in the reaction of the foregoing acid component and alcohol component [(acid component)/(alcohol component)] varies depending upon the reaction condition or the like, and therefore, it cannot be unequivocally defined. However, in the case of direct polycondensation, in general, the molar ratio of the acid component to the alcohol component is from 0.9/1.0 to 1.0/0.9. In the case of ester interchange reaction, there may be the case where a monomer which can be removed in vacuo, such as ethylene glycol, propylene glycol, neopentyl glycol and cyclohexanedimethanol, is excessively used.

A catalyst which can be used in the manufacture of the amorphous polyester resin is a tin based catalyst such as tin, tin formate, tin oxalate, tetraphenyltin, dibutyltin dichloride, dibutyltin oxide and diphenyltin oxide. However, as for the catalyst, the foregoing tin based catalyst may be mainly used as the catalyst and mixed with other catalyst.

The tin based catalyst includes an organic tin based catalyst and an inorganic tin based catalyst. The organic tin based catalyst as referred to herein is a compound having an Sn—C bond, and the inorganic tin based catalyst as referred to herein is a compound not having an Sn—C bond. The tin based catalyst is of a type such as di-type, tri-type and tetra-type, and di-type is preferably used. The inorganic tine based catalyst is preferable.

Examples of the inorganic tin based catalyst include non-branched tin alkylcarboxylates such as tin diacetate, tin dihexanoate, tin dioctanoate and tin distearate; branched tin alkylcarboxylates such as tin dineopentylate and tin di(2-ethylhexylate); tin carboxylates such as tin oxalate; dialkoxytins such as dioctyloxytin and distearoyloxytin; tin halides such as tin chloride and tin bromide; tin oxide; and tin sulfate. Of these, tin dioctanoate, tin distearate or tin oxide is especially preferable.

Examples of other catalyst include alkali metal compounds such as sodium and lithium; alkaline earth metal compounds such as magnesium and calcium; metal compounds such as zinc, manganese, antimony, titanium, zirconium and germanium; phosphorous acid compounds; phosphoric acid compounds; and amine compounds. Specific examples thereof include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl)phosphite, ethyl triphenyl phosphonium bromide, triethylamine and triphenylamine.

It is desirable to add the foregoing catalyst in an amount in the range of from 0.02 to 1.0 parts by mass based on 100 parts by mass of the foregoing monomer component in the polymerization. However, when the foregoing catalyst is mixed and used, it is desirable that a content of the tin based catalyst is 70% by mass or more, and it is more desirable that the catalyst is entirely composed of the tin based catalyst.

As for a molecular weight of the amorphous polyester resin which is used in the invention, a amorphous polyester resin having a weight average molecular weight (Mw) in the range of from 12,000 to 150,000 can be suitably used. In particular, in order to obtain an image with a high image gloss, a amorphous polyester resin having a Mw in the range of from 14,000 to 40,000 and a number average molecular weight (Mn) in the range of from 4,000 to 20,000 is more suitable, and a amorphous polyester resin having a Mw in the range of from 16,000 to 30,000 and a Mn in the range of from 5,000 to 12,000 is still more suitable. Also, Mw/Mn that is an index of the molecular weight distribution is preferably in the range of from 2 to 10. When Mw and Mn are too high, there is a concern that the color developing properties are deteriorated, whereas when Mw and Mn are too low, there is a concern that the image intensity after fixing is hardly obtained, and the hot offset is deteriorated.

In order to more improve the hot offset resistance, two kinds of amorphous polyester resins having a different molecular weight from each other can also be used. At that time, it is preferable that the amorphous polyester resin of one kind has a Mw in the range of from 35,000 to 70,000 and a Mn in the range of from 5,000 to 20,000. It is preferable that the amorphous polyester resin of the other kind has a Mw in the range of from 10,000 to 25,000 and a Mn in the range of from 3,000 to 12,000.

In the case of using two or more kinds of amorphous polyester resins, it is preferable to contain at least one of the foregoing alkyl succinates, alkenyl succinates and anhydrides thereof as a constituent component.

Though the molecular weight and molecular weight distribution can be measured by a method which is known per se, in general, the molecular weight and molecular weight distribution are measured by means of gel permeation chromatography (hereinafter abbreviated as "GPC").

The molecular weight distribution is measured under the following condition. An HLC-8120GPC, SC-8020 apparatus, manufactured by Tosoh Corporation is used as a GPC apparatus; TSK gel, Super HM-H (6.0 mm ID×15 cm×2), manufactured by Tosoh Corporation is used as a column; and THF (tetrahydrofuran) for chromatography, manufactured by Wako Pure Chemical Industries, Ltd. is used as an eluting solution. As for the experimental condition, a sample concentration is 0.5%, a flow rate is 0.6 mL/min, a sample injection amount is 10 μl, and a measurement temperature is 40° C. A calibration curve is prepared from 10 samples of A-500, F-1, F-10, F-80, F-380, A-2500, F-4, F-40, F-128 and F-700. Also, a data collection interval in the sample analysis is set to 300 ms.

An acid value of the amorphous polyester resin is desirably in the range of from 5 to 25 mg-KOH/g, and more desirably in the range of from 7 to 20 mg-KOH/g.

In this connection, the acid value is measured by weighing 2 g of a resin and dissolving it in 160 mL of acetone/toluene, or dissolving it under heating in the case where its solubility is insufficient, and then using the thus obtained sample by the neutralization titration method in conformity with JIS K0070. This applies correspondingly to the following cases.

Also, the hydroxyl value measured in conformity with JIS K0070 is desirably in the range of from 5 to 40 mg-KOH/g.

Also, a glass transition temperature of the amorphous polyester resin is desirably in the range of from 30 to 90° C., and from the standpoint of a balance between storage stability and fixability of the toner, the glass transition temperature of the amorphous polyester resin is more desirably in the range of from 50 to 70° C. When the glass transition temperature of the amorphous polyester resin is lower than 30° C., there is a concern that the toner is easy to cause blocking (a phenomenon in which the toner particles are aggregated to form a block) during the storage or in a development unit. Meanwhile, when the glass transition temperature of the amorphous polyester resin exceeds 90° C., there is a concern that the fixing temperature of the toner is high.

In this connection, the glass transition temperature of the amorphous polyester resin can be defined as an onset temperature by using a differential scanning calorimeter (DSC3110, thermal analysis system 001, manufactured by MC SCI:KK), increasing the temperature at a rate of 10° C./min from 0° C. to 150° C., holding the temperature at 150° C. for 5 minutes, decreasing the temperature at a rate of −10° C./min from 150° C. to 0° C. using liquid nitrogen, holding the temperature at 0° C. for 5 minutes and again increasing the temperature at a rate of 10° C./min from 0° C. to 150° C., followed by analysis from an endothermic curve at the time of the second temperature increase.

Furthermore, a softening temperature of the amorphous polyester resin is desirably from 80 to 130° C., and more desirably from 90 to 120° C. When the softening temperature of the amorphous polyester resin is lower than 80° C., there is a concern that the image stability of the tonner after fixing and at the time of storage is deteriorated. Meanwhile, when the softening temperature of the amorphous polyester resin exceeds 130° C., there is a concern that the low-temperature fixability is deteriorated.

The softening temperature of the resin refers to an intermediate temperature between a melt initiation temperature and a melt completion temperature measured by using a flow tester (CPT-500C, manufactured by Shimadzu Corporation) under a condition of a sample amount of 1.05 g, preheating at 65° C. for 300 seconds, a plunger pressure of 0.980665 MPa, a die size of 1 mm in diameter and a temperature rising rate of 1.0° C./min.

Also, when a temperature at which a loss elastic modulus G" of the amorphous polyester resin (measured at a measurement frequency of 1 rad/s and a distortion amount of not more than 20%) reaches 10,000 Pa is defined as Tm, it is desirable that Tm is in the range of from 80 to 150° C.

Here, the loss elastic modulus of the resin is measured in the following manner. As a measuring apparatus, a rheometer (a trade name: RDA II, manufactured by Rheometrics Co., Ltd., RHIOS system ver. 4.3) is used. A parallel plate having a diameter of 8 mm is used as a measuring plate. The measurement conditions are such that a zero point adjustment temperature is 90° C., a plate-to-plate gap is 3.5 mm, a temperature rising rate is 1° C./min, an initial measured distortion is 0.01%, and a measurement initiation temperature is 30° C. The distortion is adjusted while increasing the temperature such that a detected torque is about 10 gcm. A maximum distortion is set to be 20%. When the detection torque becomes lower than a lower limit of a measurement certified range, the measurement is completed.

Though a content of the amorphous polyester resin in the binder resin is not particularly limited, it is desirably in the range of from 80 to 98% by mass, and more desirably in the range of from 86 to 98% by mass. When the content of the amorphous polyester resin in the binder resin is less than 80% by mass, there is a concern that the toner strength is lowered, or the environmental stability of charging is deteriorated. When the content of the amorphous polyester resin in the binder resin is more than 98% by mass, there is a concern that the low-temperature fixability is not revealed.

Also, as for the binder resin, other resin than the foregoing amorphous polyester resin can be jointly used as the amorphous resin. However, the main component of the amorphous resin is the foregoing amorphous polyester resin.

Examples of resins which can be used as other resin include polystyrenes, poly(meth)acrylic acid and esters thereof. Specific examples thereof include polymers of monomers such as styrenes, for example, styrene, p-chlorostyrene and x-methylstyrene; vinyl group-containing esters, for example, methyl acrylate, ethyl acrylates, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate; vinyl nitriles, for example, acrylonitrile and methacrylonitrile; vinyl ethers, for example, vinyl methyl ether and vinyl isobutyl ether; vinyl ketones, for example, vinyl methyl ketone, vinyl ethyl ketone and vinyl isopropenyl ketone; and olefins, for example, ethylene, propylene and butadiene; and copolymers or mixtures obtained by combining two or more kinds of these monomers. Furthermore, non-vinyl condensation resins such as epoxy resins, polyester resins, polyurethane resins, polyamide resins, cellulose resins and polyether resins, and mixtures thereof with the foregoing vinyl based resins; and graft polymers obtained by polymerizing a vinyl based monomer in the presence of such a non-vinyl condensation resin. Above all, from the viewpoints chargeability and fixability, styrene-acrylic copolymer resins are preferable, and a styrene-butyl acrylate copolymer is especially preferable.

When the binder resin includes the crystalline resin, a content of the crystalline resin in the toner binder resin is preferably in the range of from 1% by mass to 10% by mass, more preferably in the range of from 1% by mass to 9% by mass, and still more preferably in the range of from 2% by mass to 8% by mass. When the content of the crystalline resin is 1% by mass or more, heat absorption by the crystalline resin at the time of fixing becomes sufficient, so that an effect to be brought by using the crystalline resin is obtainable. Also, when the content of the crystalline resin is 10% by mass or less, a domain of the crystalline resin in the toner does not become large, and an increase of the number of domains is suppressed, so that transparency of the formed image becomes good.

The content of the crystalline resin in the binder resin of the toner is calculated in the following method.

First of all, the toner is dissolved in methyl ethyl ketone (MEK) at room temperatures (from 20° C. to 25° C.). This is because, for example, when a crystalline resin such as a crystalline polyester and an amorphous resin are contained in the toner, only the amorphous resin is substantially dissolved in MEK at ordinary temperatures. In consequence, since the amorphous resin is contained in an MEK-soluble matter, after the dissolution, the amorphous resin is obtained from a supernatant separated by centrifugation. Meanwhile, a solid after the centrifugation is heated at 65° C. for 60 minutes and dissolved in MEK, the solution is filtered at 60° C. by a glass filter, and the crystalline resin such as a crystalline polyester is then obtained from the filtrate. In this operation, when the temperature decreases during the filtration, the crystalline resin is deposited. Therefore, the operation is performed quickly in a state where the temperature is kept in such a manner that the temperature does not decrease. The amount of the thus obtained crystalline resin is measured, thereby determining the content of the crystalline resin.

In the present exemplary embodiment, the term "crystalline" of the "crystalline resin" refers to the matter that in the differential scanning calorimetry (DSC) of the resin, the resin does not reveal a stepwise change in endothermic amount but reveals not only a distinct endothermic peak at the temperature increasing stage but a distinct exothermic peak is revealed at the temperature decreasing stage. Specifically, in the differential scanning calorimetry (DSC) using a differential scanning calorimeter, manufactured by Shimadzu Corporation (device name: DSC-60 Model), when the temperature is increased from 0° C. to 150° C. at a rate of 10° C./min, kept at 150° C. for 5 minutes, decreased to 0° C. at a rate of −10° C./min, kept at 0° C. for 5 minutes and then again increased to 150° C. at a rate of 10° C./min, the case where in the second temperature increasing spectrum, the endothermic amount is 25 J/g or more is defined such that a "distinct" endothermic peak is revealed. Meanwhile, the case where a temperature of from an onset point at the time of temperature decrease to a peak top of the exothermic peak is within 15° C., and the exothermic amount is 25 J/g or more is defined such that a "distinct" exothermic peak is revealed.

Also, from the viewpoint of sharp melt properties, a temperature of from the onset point to a peak top of the endothermic peak is preferably within 15° C., and more preferably within 10° C. In the DSC curve, a point of intersection of tangents between an arbitrary point in a flat part of the baseline and a point where a value obtained by differentiating the spectral curve of from trailing from the baseline to the peak top becomes maximum (a point where a gradient of the spectrum most stands up) is denoted as the "onset point". Also, when formed into a toner, there may be the case where the endothermic peak exhibits a peak having a width of from 40° C. to 50° C.

Meanwhile, the "amorphous resin" which is used as the binder resin refers to a resin which does not fall within the foregoing crystalline resin. Specifically, in the differential scanning calorimetry (DSC) using a differential scanning calorimeter, manufactured by Shimadzu Corporation (device name: DSC-60 Model), when the temperature is increased at a temperature increasing rate of 10° C./min, the case where a temperature of from an onset point to the peak top of the endothermic peak exceeds 15° C., or a distinct endothermic peak is not perceived, or the case where a distinct exothermic peak is not perceived at the time of temperature decrease, is defined such that the resin is "amorphous". Also, a method for determining the "onset point" in the DSC curve is the same as the case of the foregoing "crystalline resin".

Specific examples of the crystalline resin include crystalline polyester resins and crystalline vinyl based resins. Of these, from the viewpoints of adhesion and chargeability to paper at the time of fixing and adjustment of the melting temperature in a preferred range, crystalline polyester resins are preferable. Also, aliphatic crystalline polyester resins having a moderate melting temperature are more preferable.

Examples of the crystalline vinyl based resin include vinyl based resins using a long-chain alkyl or alkenyl (meth)acrylate, such as amyl (meth)acrylate, hexyl (meth)acrylate, heptyl (meth)acrylate, octyl (meth)acrylate, nonyl (meth)acrylate, decyl (meth)acrylate, undecyl (meth)acrylate, tridecyl (meth)acrylate, myristyl (meth)acrylate, cetyl (meth)acrylate, stearyl (meth)acrylate, oleyl (meth)acrylate and behenyl (meth)acrylate. In this specification, the term "(meth)acrylate" includes both "acrylate" and "methacrylate".

(Crystalline Polyester Resin)

The crystalline polyester resin is a resin synthesized from a divalent acid (dicarboxylic acid) component and a dihydric alcohol (diol) component, and the "crystalline polyester resin" refers to the matter that in the differential scanning calorimetry (DSC), the resin does not reveal a stepwise change in endothermic amount but reveals a distinct endothermic peak. Also, in the case of a polymer in which other component is copolymerized on a main chain of the crystalline polyester resin, when the proportion of other component is 50% by mass or less, the subject copolymer is also called the crystalline polyester resin.

In the crystalline polyester resin, as the acid serving as an acid-derived constituent unit, various dicarboxylic acids are exemplified. The dicarboxylic acid as the acid-derived constituent unit is not limited to a single kind, but two or more kinds of a dicarboxylic acid-derived constituent unit may be contained. Also, for the purpose of making emulsification properties in an emulsion aggregation method good, a sulfonic acid group may be incorporated into the dicarboxylic acid.

The foregoing "acid-derived constituent unit" refers to a constituent site that is an acid component before the synthesis of the polyester resin; and an "alcohol-derived constituent unit" as described later refers to a constituent site that is an alcohol component before the synthesis of the polyester resin.

As the dicarboxylic acid, an aliphatic dicarboxylic acid is preferable, and a linear type carboxylic acid is especially suitable. Examples of the linear type carboxylic acid include oxalic acid, malonic acid, succinic acid, glutaric acid, adipic acid, pimelic acid, suberic acid, azelic acid, sebacic acid, 1,9-nonanedicarboxylic acid, 1,10-decanedicarboxylic acid, 1,11-undecanedicarboxylic acid, 1,12-dodecanedicarboxy acid, 1,13-tridecanedicarboxylic acid, 1,14-tetradecanedicarboxylic acid, 1,18-octadecanedicarboxylic acid and 1,20-eicoanedicarboxylic acid, and lower alkyl esters or acid anhydrides thereof.

Above all, those having a carbon number of from 6 to 10 are preferable. For the purpose of increasing the crystallinity, such a linear type dicarboxylic acid is used in a proportion of preferably 95% by constituent mole or more, and more preferably 98% by constituent mole or more of the acid-derived constituent unit. The "% by constituent mole" refers to a percentage when each of the constituent units (the acid-derived constituent unit and the alcohol-derived constituent unit) in the polyester resin is defined as one unit (mole).

The acid-derived constituent unit can include, in addition to the aliphatic dicarboxylic acid-derived constituent unit, a constituent component such as a sulfonic acid group-containing dicarboxylic acid-derived constituent unit.

In the crystalline polyester resin, an aliphatic dialcohol is preferable as the alcohol serving as the alcohol-derived constituent unit. Examples thereof include ethylene glycol, 1,3-propanediol, 1,4-butanediol, 1,5-pentanedial, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol and 1,20-eicosanediol. Above all, those having a carbon number of from 2 to 10 are preferable. For the purpose of increasing the crystallinity, such a linear type dialcohol is used in a proportion of preferably 95% by constituent mole or more, and more preferably 98% by constituent mole or more of the alcohol-derived constituent unit.

Other examples of the dihydric alcohol include bisphenol A, hydrogenated bisphenol A, an ethylene oxide and/or propylene oxide adduct of bisphenol A, 1,4-cyclohexanediol, 1,4-cyclohexanedimethanol, diethylene glycol, propylene glycol, dipropylene glycol, 1,3-butanediol and neopentyl glycol. These materials may be used singly or in combinations of two or more kinds thereof.

If desired, for the purposes of adjusting an acid value or hydroxyl value and so on, a monovalent acid such as acetic acid and benzoic acid; a monohydric alcohol such as cyclohexanol and benzyl alcohol; a trivalent or more polyvalent acid such as benzenetricarboxylic acid and naphthalenetricarboxylic acid, or an anhydride or lower alkyl ester thereof; or a trihydric or more polyhydric alcohol such as glycerin, trimethylolethane, trimethylolpropane and pentaerythritol can also be used jointly.

Other monomer is not particularly limited, and conventionally known divalent carboxylic acids or dihydric alcohols are useful. As for specific examples of these monomer components, examples of the divalent carboxylic acid include dibasic acids such as phthalic acid, isophthalic acid, terephthalic acid, naphthalene-2,6-dicarboxylic acid, naphthalene-2,7-dicarboxylic acid and cyclohexanedicarboxylic acid; and anhydrides or lower alkyl esters thereof. These materials may be used singly or in combinations of two or more kinds thereof.

The crystalline polyester resin can be synthesized through an arbitrary combination among the foregoing monomer components by adopting a conventionally known method. An ester interchange method, a direct polycondensation method or the like can be adopted singly or in combinations.

Specifically, the synthesis can be performed at a polymerization temperature of from 140° C. to 270° C., and if desired, the reaction is performed by evacuating the inside of the reaction system while removing water or an alcohol generated at the condensation. When the monomer is not dissolved or compatibilized at the reaction temperature, the monomer may be dissolved by the addition of a high-boiling solvent as a dissolution assisting solvent. It is preferable to perform the polycondensation reaction while distilling off the dissolution assisting solvent. When a monomer with poor compatibility is existent in the copolymerization reaction, it would be better to condense the monomer with poor compatibility and an acid or alcohol scheduled to be polycondensed with the subject monomer in advance, followed by polycondensation with the main component.

A molar ratio in the reaction of the foregoing acid component and alcohol component (acid component)/(alcohol component) varies depending upon the reaction condition or the like, and therefore, it cannot be unequivocally defined. However, in the case of direct polycondensation, in general, the molar ratio of the acid component to the alcohol component is preferably from 0.9/1.0 to 1.0/0.9. In the case of ester interchange reaction, there may be the case where a monomer which can be removed in vacuo, such as ethylene glycol, propylene glycol, neopentyl glycol and cyclohexanedimethanol, is excessively used.

A catalyst which can be used in the manufacture of the crystalline polyester resin is a titanium-containing catalyst, and examples thereof include aliphatic titanium carboxylates such as aliphatic titanium monocarboxylates (for example, titanium acetate, titanium propionate, titanium hexanoate, titanium octanoate, etc.), aliphatic titanium dicarboxylates (for example, titanium oxalate, titanium succinate, titanium maleate, titanium adipate, titanium sebacate, etc.), aliphatic titanium tricarboxylates (for example, titanium hexanetricarboxylate, titanium isooctanetricarboxylate, etc.) and aliphatic titanium polycarboxylates (for example, titanium octanetetracarboxylate, titanium decanetetracarboxylate, etc.); aromatic titanium carboxylates such as aromatic titanium monocarboxylates (for example, titanium benzoate, etc.), aromatic titanium dicarboxylates (for example, titanium phthalate, titanium terephthalate, titanium isophthalate, titanium naphthalenedicarboxylate, titanium biphenyldicarboxylate, titanium anthracenedicarboxylate, etc.), aromatic titanium tricarboxylates (for example, titanium trimellitate, titanium naphthalenetricarboxylate, etc.) and aromatic titanium tetracarboxylates (for example, titanium benzenetetracarboxylate, titanium naphthalenetetracarboxylate, etc.); titanyl compounds of aliphatic titanium carboxylates or aromatic titanium carboxylates and alkali metal salts thereof; halogenated titanium compounds such as dichlorotitanium, trichlorotitanium, tetrachlorotitanium and tetrabromotitanium; tetraalkoxy titanium compounds such as tetrabutoxy titanium (titanium tetrabutoxide), tetraoctoxy titanium and tetrastearyloxy titanium; titanium acetylacetonate; titanium diisopropoxide bisacetylacetonate; and titanium triethanol aminate.

However, as for the catalyst, the foregoing titanium-containing catalyst or an inorganic tin based catalyst may be mainly used and mixed with other catalyst. As other catalyst, those described above for the amorphous polyester resin can be used.

At the polymerization, it is preferable to add the catalyst in an amount ranging from 0.02 parts by mass to 1.0 part by mass based on 100 parts by mass of the monomer component (exclusive of dodecenyl succinic acid). However, when the catalyst is mixed and used, it is preferable that a content of the titanium-containing catalyst is 70% by mass or more, and it is more preferable that the whole of the catalyst is occupied by the titanium-containing catalyst.

A melting temperature of the crystalline polyester resin is preferably in the range of from 50° C. to 120° C., and more preferably in the range of from 60° C. to 110° C. Furthermore, as described later, when a hydrocarbon based wax is added to the orange toner, it is preferable that the melting temperature of the crystalline polyester is lower than a melting temperature of the hydrocarbon based wax.

As for a molecular weight of the crystalline polyester resin, in the molecular weight measurement of a tetrahydrofuran (THF)-soluble matter by the GPC method, a mass average molecular weight (Mw) thereof is preferably in the range of from 5,000 to 100,000, and more preferably in the range of from 10,000 to 50,000; and a number average molecular weight (Mn) thereof is preferably in the range of from 2,000 to 30,000, and more preferably in the range of from 5,000 to 15,000. Molecular weight distribution (Mw/Mn) is preferably in the range of from 1.5 to 20, and more preferably in the range of from 2 to 5. At the measurement of the molecular weight, for the purpose of enhancing the solubility in THF, it is preferable to heat and dissolve the crystalline resin on a hot water bath at 70° C.

An acid value of the crystalline polyester resin is preferably in the range of from 4 mg-KOH/g to 20 mg-KOH/g, and more preferably in the range of from 6 mg-KOH/g to 15 mg-KOH/g. Also, a hydroxyl value of the crystalline polyester resin is preferably in the range of from 3 mg-KOH/g to 30 mg-KOH/g, and more preferably in the range of from 5 mg-KOH/g to 15 mg-KOH/g.

(Release Agent)

It is preferable that the orange toner of the invention contains a release agent. The release agent to be used is preferably a material having a main maximum endothermic peak at from 60° C. to 120° C. in a DSC curve measured in conformity with ASTM D3418-8 and a melt viscosity of from 1 mPa·s to 50 mPa·s at 140° C.

An endothermic initiation temperature of the release agent in the DSC curve measured by a differential scanning calorimeter is preferably 40° C. or more, and more preferably 50° C. or more. The endothermic initiation temperature varies depending on a low-molecular weight component in the molecular weight distribution constituting the wax or the kind or amount of a polar group contained in the structure of such a component.

In general, when the molecular weight is increased, the endothermic initiation temperature increases along with the melting temperature. However, in that case, the low melting temperature and low viscosity inherent to the wax (release agent) are deteriorated. Therefore, it is effective to selectively remove the low-molecular weight component out of the molecular weight distribution of the wax, and examples of a method include molecular distillation, solvent fractionation and gas chromatographic separation.

The measurement of DSC is as described above.

The melt viscosity of the release agent is measured by an E-type viscometer. At the measurement, an E-type viscometer (manufactured by Tokyo Keiki Inc.) equipped with an oil circulating thermostat is used. The measurement is performed using a plate by a cone and plate/cup combination with a cone angle of 1.34°. A sample is charged into the cup, the temperature of a circulating device is set up at 140° C., an empty measuring cup and a cone are set in the measuring device, and the temperature is kept constant by circulating an oil. When the temperature is stabilized, 1 g of the sample is put in the measuring cup and allowed to stand for 10 minutes in a state of the cone being stationary. After stabilization, the cone is rotated, and the measurement is performed. A rotation rate of the cone is set up at 60 rpm. The measurement is performed three times, and an average value thereof is defined as a melt viscosity (η).

Specific examples of the release agent include hydrocarbon based waxes such as polyethylene wax, polypropylene wax, polybutene wax and paraffin wax; silicones showing a softening temperature under heating; fatty acid amides such as oleic acid amide, erucic acid amide, ricinoleic acid amide and stearic acid amide; vegetable waxes such as carnauba wax, rice wax, candelilla wax, Japan wax and jojoba oil; animal waxes such as bees wax; ester waxes such as a fatty acid ester and a montanic acid ester; mineral or petroleum waxes such as montan wax, ozokerite, ceresin, microcrystalline wax and Fischer-Tropsch wax; and modified products thereof.

In the present exemplary embodiment, it is preferable to use a hydrocarbon based wax having a melting temperature of 60° C. or higher or about 60° C. or higher and lower than 100° C. or lower than about 100° C. It is more preferable to use a hydrocarbon based wax having a melting temperature of 80° C. or higher or about 80° C. or higher and lower than 95° C. or lower than about 95° C. In particular, in the case of using a crystalline polyester resin as the binder resin, when the hydrocarbon based wax is used jointly, the compatibility with C.I. Pigment Orange 38 as the coloring agent is enhanced, whereby the aggregation of C.I. Pigment Orange 38 can be more suppressed. At that time, when the melting temperature of the hydrocarbon based wax is higher than the melting temperature of the crystalline polyester resin, the crystalline polyester resin is first melted at the time of fixing and compatibilized with the amorphous polyester resin, and the hydrocarbon based wax is melted at the stage where a solubility parameter is lowered. Therefore, the formation of a domain of the hydrocarbon based wax can be suppressed. At the same time, since the formation of a domain of C.I. Pigment Orange 38 can be suppressed, the color developing properties can be more enhanced.

In the present exemplary embodiment, a proportion of the crystalline polyester resin in the binder resin is preferably from 1% by mass to 10% by mass or from about 1% by mass to about 10% by mass, and more preferably from 2% by mass to 8% by mass or from about 2% by mass to about 8% by mass of the binder resin component. When the proportion of the crystalline polyester resin is 1% by mass or more or about 1% by mass or more, a lowering amount of the solubility parameter at the time of compatibilizing with the amorphous polyester resin is large, the formation of domains of the wax and C.I. Pigment Orange 38 is suppressed, and the color developing properties are enhanced. Also, when the proportion of the crystalline polyester resin is 10% by mass or less or about 10% by mass, the formation of the crystalline resin itself is suppressed, and the color developing properties are enhanced.

An addition amount of the release agent is preferably from 1 part by mass to 15 parts by mass, and more preferably from 3 parts by mass to 10 parts by mass based on 100 parts by mass of the binder resin. When the addition amount of the release agent is 1 part by mass or more, the effect to be brought by the addition of the release agent is exhibited. Also, when the addition amount of the release agent is not more than 15 parts by mass, not only the matter that fluidity of the toner is extremely deteriorated is prevented from occurring, but the matter that charge distribution becomes very wide is prevented from occurring.

(Other Components)

In the orange toner according to the present exemplary embodiment, an inorganic or organic particle can be added, if desired.

Examples of the inorganic particle which can be added include silica, hydrophobilized silica, alumina, titanium oxide, calcium carbonate, magnesium carbonate, tricalcium phosphate, colloidal silica, alumina-treated colloidal silica, cation surface-treated colloidal silica and anion surface-treated colloidal silica. These materials can be used singly or in combinations. Above all, it is preferable to use colloidal silica. Its particle size is suitably from 5 nm to 100 nm. Also, particles having a different particle size from each other can be used jointly. Though the particle can be directly added at the manufacture of the toner, it is preferable to use a dispersion of the particle dispersed previously in a water-soluble medium such as water using an ultrasonic disperser or the like. At the time of dispersing the particle, an ionic surfactant or a polymer acid or polymer base can also be used to enhance the dispersibility.

In addition, a known material such as a charge controlling agent may also be added to the toner. A number average particle size of the material to be added is preferably not more than 1 μm, and more suitably from 0.01 μm to 1 μm. Such a number average particle size can be, for example, measured by using Microtrac or the like.

<Manufacture of Toner Particle>

For a manufacturing method of the orange toner according to the present exemplary embodiment, a generally adopted kneading pulverization method or wet granulation method or the like may be utilized. Examples of the wet granulation method include a suspension polymerization method, an emulsion polymerization method, an emulsion polymerization aggregation method, a soap-free emulsion polymerization method, a nonaqueous dispersion polymerization method, an in-situ polymerization method, an interfacial polymerization method, an emulsion dispersion granulation method and an aggregation/coalescence method. Above all, from the viewpoint of encapsulating a crystalline resin in the toner, a wet granulation method is preferable.

As the wet granulation method, known melt suspension method, emulsion aggregation method and dissolution suspension method and so on are suitably exemplified. The manufacturing method is described below by referring to the emulsion aggregation method as an example.

The emulsion aggregation method is a manufacturing method including a step of forming an aggregated particle in a dispersion liquid having a resin particle dispersed therein (hereinafter sometimes referred to as an "emulsion liquid") to prepare an aggregated particle dispersion liquid (aggregating step) and a step of heating the aggregated particle dispersion liquid to fuse an aggregated particle (coalescing step). Also, a step of dispersing an aggregated particle (dispersing step) may be provided before the aggregating step, or a step of adding and mixing a particle dispersion liquid having a particle dispersed therein in the aggregated particle dispersion liquid to adhere a particle to the aggregated particle and form an adhered particle (adhering step) may be provided between the aggregating step and the coalescing step. In the adhering step, the particle dispersion liquid is added and mixed in the aggregated particle dispersion liquid prepared in the aggregating step to adhere the particle to the aggregated particle and form an adhered particle; however, in relation to the aggregated particle, the particle added comes under a particle newly added to the aggregated particle, and therefore, it is sometimes referred to as an "additional particle".

Besides the resin particle, examples of the additional particle include a release agent particle and a coloring agent particle, and these particles may be used singly or in combinations of a plural kind thereof. Though a method for adding and mixing the particle dispersion liquid is not particularly limited, the dispersion liquid may be continuously performed step-by-step, or it may be divided plural times and added stepwise. By providing the foregoing adhering step, a pseudo shell structure can be formed.

In the toner, it is preferable to form a core-shell structure by an operation of adding the foregoing additional particle. The binder resin serving as the main component of the additional particle is a resin for shell layer. Use of this method facilitates controlling the toner shape by adjusting a temperature, a stirring number, a pH or the like in the coalescing step.

In the foregoing emulsion aggregation method, the crystalline polyester resin dispersion liquid is used, and an amorphous polyester resin dispersion liquid is preferably used in combinations. It is more preferable to include an emulsifying step of emulsifying the crystalline polyester resin dispersion liquid and the amorphous polyester resin to form an emulsified particle (liquid droplet).

In the emulsifying step, it is preferable that the emulsified particle (liquid droplet) of the amorphous polyester resin is formed by applying a shear force to a solution obtained by mixing an aqueous medium, an amorphous polyester resin and optionally, a coloring agent-containing mixed solution (polymer solution). On that occasion, the emulsified particle can also be formed by decreasing the viscosity of the polymer liquid under heating to a temperature of the glass transition temperature of the amorphous polyester resin or higher. Also, a dispersant can be used. The dispersion liquid of such an emulsified particle is hereinafter sometimes referred to as an "amorphous polyester resin dispersion liquid".

Examples of an emulsifier which is used at the formation of the emulsified particle include a homogenizer, a homomixer, a pressure kneader, an extruder and a media disperser. A size of the emulsified particle (liquid droplet) of the polyester resin is preferably from 0.010 μm to 0.5 μm, and more preferably from 0.05 μm to 0.3 μm in terms of an average particle size (volume average particle size). In this respect, the volume average particle size of the resin particle is measured by a Doppler scattering particle size distribution analyzer (Microtrac UPA9340, manufactured by Nikkiso Co., Ltd.).

Also, when the melting viscosity of the resin at the time of emulsification is high, the particle size does not become small to a desired value. Therefore, by increasing the temperature using an emulsifier capable of applying a pressure to an atmospheric pressure or more and performing emulsification in a state where the resin viscosity is decreased, an amorphous polyester resin dispersion liquid having a desired particle size can be obtained.

In the emulsifying step, for the purpose of decreasing the viscosity of the resin, a solvent may be previously added to the resin. The solvent used is not particularly limited so far as it is able to dissolve the polyester resin therein. Examples of the solvent which can be used include ether based solvents such as tetrahydrofuran (THF); ester based or ketone based solvents such as methyl acetate, ethyl acetate and methyl ethyl ketone; and benzene based solvents such as benzene, toluene and xylene. It is preferable to use an ester based or ketone based solvent such as ethyl acetate and methyl ethyl ketone.

Also, an alcohol based solvent such as ethanol and isopropyl alcohol may be added directly to water or the resin. Also, a salt such as sodium chloride and potassium chloride, or ammonia may be added. Of these, ammonia is preferably used.

Furthermore, a dispersant may be added. Examples of the dispersant include water-soluble polymers such as polyvinyl alcohol, methyl cellulose, carboxymethyl cellulose and sodium polyacrylate; surfactants such as anionic surfactants (for example, sodium dodecylbenzenesulfonate, sodium octadecylsulfate, sodium oleate, sodium laurate, potassium stearate, etc.), cationic surfactants (for example, laurylamine acetate, lauryltrimethylammonium chloride, etc.), amphoteric ionic surfactants (for example, lauryldimethylamine oxide) and nonionic surfactants (for example, polyoxyethylene alkyl ethers, polyoxyethylene alkylphenyl ethers, polyoxyethylene alkylamines, etc.); and inorganic compounds such as tricalcium phosphate, aluminum hydroxide, calcium sulfate, calcium carbonate and barium carbonate. Of these, an anionic surfactant is suitably used.

A use amount of the dispersant is preferably from 0.01 parts by mass to 20 parts by mass based on 100 parts by mass of the binder resin. However, since the dispersant often affects the chargeability, when emulsifiability can be ensured by hydrophilicity of the main chain of the polyester resin or the amount of the acid value or hydroxyl value at the terminal or the like, it would be better that the dispersant is not added as far as possible.

In the emulsifying step, a dicarboxylic acid having a sulfonic acid group may be copolymerized in the amorphous polyester resin (namely, an appropriate amount of a constituent unit derived from a dicarboxylic acid having a sulfonic acid group is contained in an acid-derived constituent unit). An addition amount thereof is preferably 10 mol % or less in the acid-derived constituent unit. However, when emulsifiability can be ensured by hydrophilicity of the main chain of the polyester resin or the amount of the acid value or hydroxyl value at the terminal or the like, it would be better that the dicarboxylic acid having a sulfonic acid group is not added as far as possible.

Also, a phase inversion emulsification method may be adopted in forming the emulsified particle. The phase inversion emulsification method is a method of dissolving the amorphous polyester resin in a solvent, optionally adding a neutralizing agent or a dispersion stabilizer, adding dropwise an aqueous medium under stirring to obtain an emulsified particle and then removing the solvent in the resin dispersion liquid to obtain an emulsion liquid. At that time, the charging order of the neutralizing agent or dispersion stabilizer may be changed.

Examples of the solvent capable of dissolving the resin therein include formic acid esters, acetic acid esters, butyric acid esters, ketones, ethers, benzenes and halogenated carbons. Specific examples thereof include esters of formic acid, acetic acid or butyric acid, such as methyl, ethyl, n-propyl, isopropyl, n-butyl, isobutyl, sec-butyl and tert-butyl esters; methyl ketones such as acetone, methyl ethyl ketone (MEK), methyl propyl ketone (MPK), methyl isopropyl ketone (MIPK), methyl butyl ketone (MBK) and methyl isobutyl ketone (MIBK); ethers such as diethyl ether and diisopropyl ether; heterocyclic ring substitution products such as toluene, xylene and benzene; and halogenated carbons such as carbon tetrachloride, methylene chloride, 1,2-dichloroethane, 1,1,2-trichloroethane, trichloroethylene, chloroform, monachlorobenzene and dichloroethylidene. These solvents can be used singly or in combinations of two or more kinds thereof. Above all, acetic acid esters, methyl ketones and ethers, which are a low-boiling solvent, are, in general, preferably used, and acetone, methyl ethyl ketone, acetic acid, ethyl acetate and butyl acetate are especially preferable. The solvent to be used is preferably a solvent with relatively high volatility such that it does not remain in the resin particle. A use amount of such a solvent is preferably from 20% by mass to 200% by mass, and more preferably from 30% by mass to 100% by mass relative to the amount of the resin.

Basically, ion-exchanged water is used as the aqueous medium. However, a water-soluble solvent may be contained to an extent that it does not collapse an oil droplet. Examples of the water-soluble solvent include short carbon chain alcohols such as methanol, ethanol, 1-propanol, 2-propanol, 1-butanol, 2-butanol, tert-butanol and 1-pentanol; ethylene glycol monoalkyl ethers such as ethylene glycol monomethyl ether, ethylene glycol monoethyl ether and ethylene glycol monobutyl ether; ethers; dials; THF; and acetone. Of these, ethanol or 2-propanol is preferably used.

A use amount of such a water-soluble solvent is preferably from 0% by mass to 100% by mass, and more preferably from 5% by mass to 60% by mass % relative to the amount of the resin. Also, not only the water-soluble solvent may be mixed with ion-exchanged water to which the resin is added, but it may be used by adding to a solution in which the resin is dissolved.

Also, if desired, a dispersant may be added to the amorphous polyester resin solution and the aqueous component. Examples of the dispersant include a dispersion stabilizer that forms a hydrophilic colloid in the aqueous component, especially inclusive of cellulose derivatives (for example, hydroxymethyl cellulose, hydroxyethyl cellulose, hydroxypropyl cellulose, etc.), synthetic polymers (for example, polyvinyl alcohol, polyvinylpyrrolidone, polyacrylamide, polyacrylates, polymethacrylates, etc.), gelatin, gum arabic and agar.

Also, a solid powder such as silica, titanium oxide, alumina, tricalcium phosphate, calcium carbonate, calcium sulfate and barium carbonate can be used. In general, such a dispersion stabilizer is added in a concentration in the aqueous component of preferably from 0% by mass to 20% by mass %, and more preferably from 0% by mass to 10% by mass.

A surfactant is also used as the dispersant. Examples of the surfactant include those used for a coloring agent dispersion liquid described later. Examples thereof include, in addition to natural surfactant components such as saponin, cationic surfactants such as alkylamine hydrochlorides or acetates, quaternary ammonium salts and glycerins; and anionic surfactants such as fatty acid soaps, sulfuric acid esters, alkylnaphthalene sulfonates, sulfonates, phosphoric acid, phosphoric acid esters and sulfosuccinates. Of these, an anionic surfactant or a nonionic surfactant is preferably used.

In order to adjust the pH of the emulsion liquid, a neutralizing agent may also be added. Examples of the neutralizing agent which can be used include general acids and alkalis such as nitric acid, hydrochloric acid, sodium hydroxide and ammonia.

As a method for removing the solvent from the emulsion liquid, a method of heating the emulsion liquid at a temperature of from 15° C. to 70° C. to volatilize the solvent, or a method of combining this with reduced pressure is preferably adopted.

In the present exemplary embodiment, from the viewpoint of controlling the particle size distribution or particle size, it is preferable to adopt a method in which after emulsification by a phase inversion emulsification method, the solvent is removed by heating under reduced pressure. Also, in the case of using the emulsified particle for the toner, from the viewpoint of influences against chargeability, it is preferable to control the emulsifiability by hydrophilicity of the main chain of the polyester resin or the amount of the acid value or hydroxyl value at the terminal or the like, without using a dispersant or a surfactant as far as possible.

The emulsification of the crystalline polyester can be performed by the same operation as in the case of the foregoing amorphous polyester resin. In the emulsifying step, it is preferable that the emulsified particle (liquid droplet) of the crystalline polyester resin is formed by applying a shear force to a solution obtained by mixing an aqueous medium, a crystalline polyester resin and optionally, a coloring agent-containing mixed solution (polymer solution). On that occasion, the emulsified particle can be formed by once dissolving the crystalline polyester resin under heating to a temperature of the melting temperature of the crystalline polyester resin or higher and then emulsifying the solution at a temperature higher by from 10° C. to 20° C. than a recrystallization temperature, thereby decreasing the viscosity of the polymer liquid. Also, a dispersant can be used. The dispersion liquid of such an emulsified particle is hereinafter sometimes referred to as a "crystalline polyester resin dispersion liquid".

The method for dispersing the coloring agent or release agent is not limited at all, and, for example, a general dispersing method such as those using a high-pressure homogenizer, a rotary shearing type homogenizer, an ultrasonic disperser, a high-pressure counter collision disperser or a media-containing mill (for example, a ball mill, a sand mill, a Dyno mill, etc.) may be adopted.

If desired, an aqueous dispersion liquid of the coloring agent can be prepared using a surfactant, or an organic solvent dispersion liquid of the coloring agent may be prepared using a dispersant. The dispersion liquid of the coloring agent or release agent is hereinafter sometimes referred to as a "coloring agent dispersion liquid" or a "release agent dispersion liquid", respectively.

The dispersant which is used in the coloring agent dispersion liquid or release agent dispersion liquid is generally a surfactant. Suitable examples of the surfactant include anionic surfactants such as sulfuric ester salt based, sulfonate based, phosphoric acid ester based or soap based surfactants; cationic surfactants such as amine salt type or quaternary ammonium salt type surfactants; and nonionic surfactants such as polyethylene glycol based, alkyl phenol ethylene oxide adduct based or polyhydric alcohol based surfactants. Of these, ionic surfactants are preferable, and anionic surfactants or cationic surfactants are more preferable. The nonionic surfactant may be used jointly with the anionic surfactant or cationic surfactant. Also, it is preferable that the surfactant has the same polarity as the dispersant which is used in other dispersion liquids such as the release agent dispersion liquid.

Specific examples of the anionic surfactant include fatty acid soaps such as potassium laurate and sodium oleate; sulfuric acid esters such as octyl sulfate and lauryl sulfate; sulfonates such as lauryl sulfonate, dodecyl sulfonate, a sodium alkylnaphthalenesulfonate (for example, dodecylbenzene sulfonate, etc.), a naphthalene sulfonate formalin condensate, monooctyl sulfosuccinate and dioctyl sulfosuccinate; phosphoric acid esters such as lauryl phosphate and isopropyl phosphate; and sulfosuccinates such as sodium dialkylsulfosuccinates (for example, sodium dioctylsulfosuccinate, etc.), disodium lauryl sulfosuccinate and disodium lauryl polyoxyethylenesulfosuccinate. Of these, alkylbenzene sulfonate based compounds such as dodecylbenzene sulfonate and its branched form are preferable.

Specific examples of the cationic surfactant include amine salts such as laurylamine hydrochloride and stearylamine hydrochloride; and quaternary ammonium salts such as lauryltrimethylammonium chloride and dilauryldimethylammonium chloride.

Specific examples of the nonionic surfactant include alkyl ethers such as polyoxyethylene octyl ether and polyoxyethylene lauryl ether; alkyl phenyl ethers such as polyoxyethylene octyl phenyl ether and polyoxyethylene nonyl phenyl ether; alkyl esters such as polyoxyethylene laurate, polyoxyethylene stearate and polyoxyethylene oleate; alkylamines such as polyoxyethylene laurylamino ether, polyoxyethylene stearylamino ether and polyoxyethylene oleylamino ether; alkylamides such as polyoxyethylene lauric acid amide and polyoxyethylene stearic acid amide; vegetable oil ethers such as polyoxyethylene castor oil ether and polyoxyethylene rapeseed oil ether; alkanolamides such as lauric acid diethanolamide, stearic acid diethanolamide and oleic acid diethanolamide; and sorbitan ester ethers such as polyoxyethylene sorbitan monolaurate and polyoxyethylene sorbitan monopalmitate.

An addition amount of the dispersant which is used is preferably from 2% by mass to 30% by mass, and more preferably from 5% by mass to 10% mass relative to the coloring agent or release agent.

An aqueous dispersion solvent which is used is preferably a medium containing little impurities (for example, a metal ion, etc.), such as distilled water and ion-exchanged water. Furthermore, an alcohol or the like can also be added. Also, a polyvinyl alcohol or cellulose based polymer or the like can be added. However, it would be better that such a polymer is not used as far as possible such that it does not remain in the toner.

Though a method for preparing a dispersion liquid of various additives described above is not particularly limited, examples thereof include a dispersing device which is known by itself, such as rotary shearing type homogenizer, a media-containing mill (for example, a ball mill, a sand mill, a Dyno mill, etc.) and device in accordance with that used for manufacturing the coloring agent dispersion liquid or release agent dispersion liquid, and an optimal device can be selected and used.

In the aggregating step, for the purpose of forming an aggregated particle, it is preferable to use an aggregating agent. Examples of the aggregating agent which is used include surfactants having a polarity reverse to that of the surfactant used for the dispersant; and general inorganic metal compounds (inorganic metal salts) or polymers thereof. A metal element constituting the inorganic metal salt is a metal element having a divalent or higher electric charge belonging to the Groups 2A, 3A, 4A, 5A, 6A, 7A, 8, 1B, 2B and 3B of the Periodic Table (long period), and the metal element is sufficient so far as it is dissolved in a form of an ion in the aggregated system of resin particles.

Specific examples of the inorganic metal salt which can be used include metal salts such as calcium chloride, calcium nitrate, barium chloride, magnesium chloride, zinc chloride, aluminum chloride and aluminum sulfate; and inorganic metal salt polymers such as polyaluminum chloride, polyaluminum hydroxide and calcium polysulfide. Of these, an aluminum salt and a polymer thereof are especially suitable. In general, for the purpose of obtaining sharper particle size distribution, the valence of the inorganic metal salt is preferably divalence than monovalence, and trivalence or greater valence than divalence. Even when the valence is identical, an inorganic metal salt polymer of a polymerization type is more preferable.

Though an addition amount of such an aggregating agent varies depending upon the kind or valence of the aggregating agent, in general, it is preferably in the range of from 0.05% by mass to 0.1% by mass. The aggregating agent flows out into the aqueous medium or forms a coarse powder in a step of forming a toner, and it is not the case where the entire amount thereof remains in the toner. In particular, in the step of forming a toner, when the amount of the solvent in the resin is large, the aggregating agent readily interacts with the solvent and easily flows out into the aqueous medium. Therefore, it is preferable to adjust the addition amount of the aggregating agent in conformity with the residual solvent amount.

In the coalescing step, it is preferable that a suspension of the aggregate is adjusted at a pH in the range of from 5 to 10 under stirring in accordance with the aggregating step, thereby stopping the progress of aggregation, and then heated at a temperature of a glass transition temperature (Tg) of the resin or higher, or at a temperature of a melting temperature of the crystalline resin (the glass transition temperature and the melting temperature will be hereinafter combined and referred to simply as "Tg or the like") to fuse and coalesce the aggregated particles. Also, a heating time is sufficient so far as it is long enough to allow the desired coalescence, and the heating may be performed for from 0.2 hours to 10 hours. Thereafter, at the time of decreasing the temperature to the Tg or the like of the resin or lower to achieve solidification of the particle, the shape and surface properties of the particle are changed depending on the temperature decreasing rate. The temperature decrease is performed to the Tg or the like of the resin or lower at a rate of preferably 0.5° C./min or more, and more preferably 1.0° C./min or more.

Also, when the particle is grown by the control of pH or addition of the aggregating agent in accordance with the aggregating step while heating the system at a temperature of the Tg or the like of the resin or higher, and at a point of reaching the desired particle size, the temperature is decreased to the Tg or the like of the resin or lower at a rate of 0.5° C./min in accordance with the case of the coalescing step to stop the particle growth simultaneously with the solidification, the aggregating step and the coalescing step can be simultaneously performed. Thus, this is preferable in view of simplification of the process, but there is a concern that it becomes difficult to prepare the foregoing core-shell structure.

After completion of the coalescing step, the particle is washed and dried to obtain a toner particle. In this respect, displacement washing with ion-exchanged water is preferably applied. The degree of washing is generally monitored by the conductivity of a filtrate, and the washing is preferably performed such that the conductivity finally becomes 25 μS/cm or less. At the washing, a step of neutralizing the ion with an acid or an alkali may be provided, and a treatment with the acid is preferably performed at a pH of 6.0 or less, whereas a treatment with the alkali is preferably performed at a pH of 8.0 or more.

Also, the solid-liquid separation after washing is not particularly limited, but in view of productivity, suction filtration, pressure filtration such as filter press or the like is preferably adopted. Furthermore, drying is also not particularly limited, but in view of productivity, freeze drying, flash jet drying, fluidized drying, vibration type fluidized drying or the like is preferably adopted, and drying may be performed such that the final toner has a moisture percentage of preferably 1% by mass or less, and more preferably 0.7% by mass or less.

<Externally Added Toner>

In the thus obtained toner particle, an inorganic particle and/or an organic particle can be externally added as an external additive and mixed as a flowing aid, a cleaning aid, an abrasive or the like.

Examples of the inorganic particle which can be externally added include all of particles which are usually used as an external additive on the toner surface, such as silica, alumina, titanium oxide, calcium carbonate, magnesium carbonate, tricalcium phosphate and cerium oxide. It is preferable that the surface of such an inorganic particle is hydrophobilized.

Example of the organic particle which can be externally added include all of particles which are usually used as an external additive on the toner surface, such as vinyl based resin (for example, styrene based polymers, (meth)acrylic polymers, ethylene based polymers, etc.), polyester resins, silicone resins and fluorine based resins.

A primary particle size of such an external additive is preferably from 0.01 μm to 0.5 μm. Furthermore, a lubricant can be added. Examples of the lubricant include fatty acid amides such as ethylene bis-stearic acid amide and oleic acid amide; fatty acid metal salts such as zinc stearate and calcium stearate; and higher alcohols such as UNILIN. A primary particle size thereof is preferably from 0.5 μm to 8.0 μm.

Also, two or more kinds of the foregoing inorganic particles are used, and one kind of the inorganic particle has an average primary particle size of preferably from 30 nm to 200 nm, and more preferably from 30 nm to 180 nm.

Specifically, silica, alumina or titanium oxide is preferable, and it is especially preferable to add hydrophobilized silica. In particular, it is preferable to use a combination of silica and titanium oxide or silicas having a different particle size. It is also preferable to use an organic particle having a particle size of from 80 nm to 500 nm in combination. As the hydrophobilizing agent for hydrophobilizing the external additive, known materials are useful, and examples thereof include coupling agents such as silane based coupling agents, titanate based coupling agents, aluminate based coupling agents and zirconium based coupling agents; and silicone oil. Also, examples of the hydrophobilizing treatment of an external additive include a polymer coating treatment.

It is preferable that the external additive is adhered or fixed to the toner surface by applying a mechanical impact force using a V-type blender, a sample mill, a Henschel mixer or the like.

<Physical Properties of Orange Toner>

(Quantitative Control of Ion Species)

In the orange toner (toner particle) according to the present exemplary embodiment, it is preferable that a Na ion ($Na^+$) amount and an $NH_4$ ion ($NH_4^+$) ion are adequately controlled.

When the ions excessively remain in the toner, the charge amount is lowered. In particular, since the charge amount is more largely lowered at a high humidity, the environmental dependency (humidity dependency) of charge characteristics becomes high. In the polyester resin, the environmental dependency of charge characteristics is easy to become high due to influences of a terminal carboxyl group thereof, and in particular, in a toner manufactured in water, the subject influences are expanded.

Then, it is preferable to improve the environmental dependency of charge characteristics by adequately quantitatively controlling a combination of ion species.

A Na ion amount and an $NH_4$ ion amount of the toner are controlled so as to satisfy relations represented by the following formulae (a) to (c):

$$0.05\ \text{mg/L} \leq (\text{Na ion amount}) \leq 0.3\ \text{mg/L} \quad \text{(a)}$$

$$0.3\ \text{mg/L} \leq (NH_4\ \text{ion amount}) \leq 1.0\ \text{mg/L} \quad \text{(b)}$$

$$1.0 \leq (NH_4\ \text{ion amount})/(\text{Na ion amount}) \leq 5.0 \quad \text{(c)}$$

wherein each of Na ion amount and $NH_4$ ion amount is a value detected by weighing 0.5 g of the toner subjective to the measurement (so-called toner particle but not the externally added toner), adding the toner to 100 g of ion-exchanged water at 30±1° C., ultrasonically dispersing it for 30 minutes, filtering the dispersion and then analyzing the filtrate by ion chromatography.

Since the Na ion is a strong base and has a strong interaction with a water molecule, an effect for suppressing the charge amount of the whole. However, when the Na ion amount is excessively high, the charge amount is excessively lowered. Meanwhile, since the $NH_4$ ion is a weak base and has a strong interaction with the carboxylic acid of the resin, the works of the carboxylic acid at a low humidity can be suppressed, and in particular, an electrification increase at a low humidity can be suppressed. Though it may be considered that such a work brings about the same effect in not only the carboxylic acid but a polar group such as an ester bonding group of the polyester main chain, the interaction force is weak as compared with the carboxylic acid, so that it is supposed that the effect is weak, too.

The foregoing formulae (a) to (c) are more preferably the following formulae (a') to (c'), respectively.

$$0.05\ \text{mg/L} \leq (\text{Na ion amount}) \leq 0.2\ \text{mg/L} \quad \text{(a')}$$

$$0.07\ \text{mg/L} \leq (NH_4\ \text{ion amount}) \leq 0.5\ \text{mg/L} \quad \text{(b')}$$

$$1.4 \leq (NH_4\ \text{ion amount})/(\text{Na ion amount}) \leq 3.2 \quad \text{(c')}$$

Examples of a method for controlling the ion amounts in the toner in the foregoing way include a method of adding the ions at a stage of preparing a resin dispersion liquid, a method of adding the ions during the toner manufacture and a method of adding and treating the ions after the toner manufacture. However, the following method is preferable.

It is important that $NH_4^+$ interacts with the resin carboxylic acid. Even when $NH_4^+$ is added in a state where Na as a strong base is already existent, Na already interacts with the carboxylic acid, and it is difficult to obtain the effects of the invention. In consequence, it is preferable to add $NH_4^+$ at the stage of manufacturing a resin dispersion liquid.

An existing amount of $NH_4^+$ in the toner can be controlled by the $NH_3$ addition amount at the time of manufacturing a resin dispersion liquid. The material to be used is preferably an ammonia aqueous solution. Also, $NH_4^+$ interacting with the carboxylic acid can be eliminated depending upon the pH. For example, by decreasing the pH by the addition of an acid to the emulsion liquid, the carboxylic acid-$NH_4^+$ interaction is substituted with carboxylic acid-$H^+$, whereby the residual amount of $NH_4^+$ in the toner can be reduced. Even which such an operation is performed at the time of manufacturing a toner, the existing amount of $NH_4^+$ can be similarly controlled.

Also, all of $NH_4^+$s do not interact with the carboxylic acid, but a part thereof interacts with a polar group such as an ester group to remain in the toner. Such residual $NH_4^+$ is relatively easily volatile, and by rendering the system in a vacuum state at the time of toner drying, its residual amount can also be controlled.

Meanwhile, the $Na^+$ amount is controlled by its addition amount at the time of manufacturing a toner. However, when the $Na^+$ amount is excessively small, there is a concern that the controllability of the particle size of the toner is deteriorated. Thus, by increasing the addition amount of $Na^+$ at the time of manufacturing a toner and adjusting the pH by an acid such as nitric acid and hydrochloric acid after manufacturing the toner, the $Na^+$ amount can be controlled. Examples of a material which is used include sodium hydroxide and a Na-neutralized surfactant. Of these, sodium hydroxide is preferable.

(Particle Size and Particle Size Characteristic)

The orange toner according to the present exemplary embodiment has a volume average particle size (particle size of the so-called toner particle exclusive of the externally added toner; the same in this section) of preferably in the range of from 3 μm to 9 μM, more preferably in the range of from 3.5 μm to 8.5 μm, and still more preferably from 4 μm to 8 μm. When the volume average particle size of the orange toner is 9 μm or less, it is easy to reproduce a high-definition image. Also, when the volume average particle size of the orange toner is 3 μm or more, the generation of a toner with a reverse polarity is suppressed, and influences against the image quality, such as fogging and color deletion, are reduced.

Also, in the orange toner according to the present exemplary embodiment, when cumulative distribution of each of the volume and the number is drawn from the small diameter side with respect to the particle size range (channel) divided on the basis of the particle size distribution measured by the following method and when the particle sizes at 16% accumulation, 50% accumulation and 84% accumulation are defined as $D_{16v}$%, $D_{50v}$% and $D_{84v}$%, respectively, the volume average particle size distribution index ($GSD_v$) calculated by $(D_{84v}\%/D_{16v}\%)^{1/2}$ is preferably from 1.15 to 1.30, and more preferably from 1.15 to 1.25.

The measurement of the volume average particle size or the like is performed using Multisizer II (manufactured by Beckman Coulter Inc.) at an aperture diameter of 100 μm. On that occasion, the measurement is performed after dispersing the toner in an electrolyte aqueous solution (an ISOTON aqueous solution) (concentration: 1% by mass), adding a surfactant (a trade name: CONTAMINON) and dispersing the mixture for 300 seconds or more by an ultrasonic disperser.

Also, as for the particle size distribution, cumulative distribution of each of the volume and the number is drawn from the small diameter side with respect to the particle size range divided on the basis of the particle size distribution measured using Multisizer II (division number: a range of from 1.59 μm to 64.0 μm is divided into 16 channels at intervals of 0.1 on the log scale; specifically, the range is divided into channel 1 of 1.59 μm or more and less than 2.00 μm, channel 2 of 2.00 μm or more and less than 2.52 μm, channel 3 of 2.52 μm or more and less than 3.175 μm, . . . such that a log value of a lower limit numerical value on the left side becomes (log 1.59=) 0.2, (log 2.0=) 0.3, (log 2.52=) 0.42, . . . 1.7), the particle size at 16% accumulation is defined as $D_{16v}$ by volume and $D_{16p}$ by number, the particle size at 50% accumulation is defined as $D_{50v}$ by volume (volume average particle size) and $D_{50p}$ by number, and the particle size at 84% accumulation is defined as $D_{84v}$ by volume and $D_{84p}$ by number.

Also, the toner preferably has a spherical shape with a shape factor SF1 in the range of from 110 to 145. When the shape is spherical in this range, transfer efficiency and denseness of the image are enhanced, and a high-quality image can be formed.

The shape factor SF1 is more preferably in the range of from 110 to 140.

The shape factor SF1 is determined according to the following expression (II).

$$SF1=(ML^2/A)\times(\pi/4)\times 100 \quad \text{(II)}$$

In the expression (II), ML represents an absolute maximum length of the toner particle; and A represents a projected area of the toner particle.

The shape factor SF1 is quantified by analyzing a microscopic image or a scanning electron microscopic (SEM) image using an image analyzer and calculated, for example, as follows. That is, an optical microscopic image of toner particles spread on a slide glass surface is incorporated into a Luzex image analyzer through a video camera, the maximum length and projected area are determined on 100 or more particles, and the shape factor is calculated according to the foregoing expression (II), following by determining an average value thereof.

When the shape factor SF1 of the toner falls within the foregoing ranges, excellent chargeability, cleaning properties and transferability are obtainable over a long period of time.

In recent years, in view of the fact that the measurement can be simply made, the measurement of the shape factor is often performed using FPIA-3000, manufactured by Sysmex Corporation. According to EPIA-3000, about 4,000 particle images are optically measured, and a projected image of every one particle is subjected to image analysis. Specifically, first of all, a peripheral length (peripheral length of the particle image) is calculated from a projected image of one particle. Subsequently, an area of the projected image is calculated, a circle having the same area as the calculated area is hypothesized, and a circumference of the circle is calculated (circumferential length determined from the circle-corresponding diameter). A circularity is calculated according to the following expression.

Circularity=(Circumferential length determined from circle-corresponding diameter)/(Peripheral length of particle image)

When the numerical value is closer to 1.0, it is meant that the shape is spherical. The circularity is preferably from 0.945 to 0.990, and more preferably from 0.950 to 0.975. When the circularity is 0.950 or more, good transfer efficiency is obtainable. Also, when the circularity is 0.975 or less, good cleaning properties are obtainable.

Though there is a device-to-device error, the shape factor SF1 of 110 is generally corresponding to a circularity of 0.990 of FPIA-3000. Also, the shape factor SF1 of 140 is generally corresponding to a circularity of 0.945 of FPIA-3000.

[Color Toner Set]

The above-described orange toner according to the present exemplary embodiment may be used as a color set together with other color toners.

That is, the color toner set according to the present exemplary embodiment includes a yellow toner containing C.I. Pigment Yellow 74, a magenta toner containing C.I. Pigment Red 238 or 269 and the orange toner according to the present exemplary embodiment.

The yellow toner is not particularly limited so far as it contains C.I. Pigment Yellow 74 as a coloring agent. However, from the viewpoints of chargeability and fixability, it is preferable that the yellow toner has the same material constitution as the orange toner according to the present exemplary embodiment. It is necessary that 80% by mass or more of the coloring agent in the toner is occupied by Pigment Yellow 74, and it is preferable that 100% by mass of the coloring agent in the toner is occupied by Pigment Yellow 74. Examples of the coloring agent other than Pigment Yellow 74, which can be mixed, include chrome yellow, zinc yellow, yellow iron oxide, cadmium yellow, chromium yellow, Hansa Yellow, Hansa Yellow 10G, Benzidine Yellow G, Benzidine Yellow GR, Threne Yellow, Quinoline Yellow and Permanent Yellow NCG. Specific examples thereof include C.I. Pigment Yellow 180, C.I. Pigment Yellow 93, C.I. Pigment Yellow 185, C.I. Pigment Yellow 155, C.I. Pigment Yellow 128, C.I. Pigment Yellow 111 and C.I. Pigment Yellow 17. From the standpoint of pigment dispersibility, C.I. Pigment Yellow 93 or C.I. Pigment Yellow 185 is preferable.

The magenta toner is not particularly limited so far as it contains C.I. Pigment Red 238 or 269 as a coloring agent. However, from the viewpoints of chargeability and fixability, it is preferable that the magenta toner has the same material constitution as the orange toner according to the present exemplary embodiment. It is necessary that 50% by mass or more of the coloring gent in the toner is occupied by C.I. Pigment Red 238 or 269, and it is preferable that 70% by mass or more of the coloring agent in the toner is occupied by C.I. Pigment Red 238 or 269. Examples of the coloring agent other than C.I. Pigment Red 238 or 269, which can be mixed, include red iron oxide, cadmium red, red lead, mercury sulfide, Watchung Red, Permanent Red 4R, Lithol Red, Brilliant Carmine 3B, Brilliant Carmine 6B, DuPont Oil Red, Pyrazolone Red, Rhodamine Lake B, Lake Red C, Rose Bengal, Eoxine Red, Alizarin Lake, a naphthol based pigment such as C.I. Pigment Red 31, C.I. Pigment Red 146, C.I. Pigment Red 147, C.I. Pigment Red 150, C.I. Pigment Red 176, and a quinacridone based pigment such as C.I. Pigment Red 122, C.I. Pigment Red 202, C.I. Pigment Red 209 and Pigment Violet 19. Of these, C.I. Pigment Red 122 or Pigment Violet 19 is preferable.

When a color set of such a combination is used, color reproductivity in a red region can be enhanced.

Also, it is preferable that the color toner set according to the present exemplary embodiment further includes a cyan toner containing a copper phthalocyanine pigment.

The cyan toner is not particularly limited so far as it contains a copper phthalocyanine pigment as a coloring agent. However, from the viewpoints of chargeability and fixability, it is preferable that the cyan toner has the same material constitution as the orange toner according to the present exemplary embodiment. In particular, it is preferable that the cyan toner includes Pigment Blue 15:3. It is necessary that 80% by mass or more of the coloring gent in the toner is occupied by Pigment Blue 15:3, and it is preferable that 100% by mass of the coloring agent in the toner is occupied by Pigment Blue 15:3.

When a color set of such a combination is used, it is possible to make the image closer to a photographic image quality.

[Orange Developer]

The orange toner according to the present exemplary embodiment is used as a one-component developer directly or as a two-component developer upon being mixed with a carrier.

Though the carrier which can be used is not particularly limited, it is preferably a carrier coated with a resin (in general, referred to as a "coated carrier" or "resin-coated carrier" or the like), and more preferably a carrier coated with a nitrogen-containing resin. Examples of the nitrogen-containing resin which is suitable for coating include an acrylic resin including dimethylaminoethyl methacrylate, dimethyl acrylamide and acrylonitrile; an amino resin including urea, urethane, melamine, guanamine and aniline; an amide resin; and a urethane resin. A copolymerized resin thereof may also be used. Of these, a urea resin, a urethane resin, a melamine resin or an amide resin is preferable.

As for the coat resin of the carrier, two or more kinds of the foregoing nitrogen-containing resins may be used in combination. Also, the nitrogen-containing resin and a nitrogen-free resin may be used in combination. Furthermore, the nitrogen-containing resin may be formed in a particulate state and used upon being dispersed in a nitrogen-free resin.

In general, the carrier needs to have an appropriate electric resistance, and specifically, it is preferable that the carrier has an electric resistance of from $10^9$ Ω·cm to $10^{14}$ Ω·cm. For example, in the case where the electric resistance is as low as $10^6$ Ω·cm, such as an iron powder carrier, it is preferable that the carrier is coated with a resin having insulating properties (volume resistivity: $10^{14}$ Ω·cm or more), and a conductive powder is dispersed in the resin-coated layer.

Specific examples of the conductive powder include a metal such as gold, silver and copper; carbon black; a semi-conductive oxide such as titanium oxide and zinc oxide; and a powder obtained by coating tin oxide, carbon black or a metal on the surface of a powder of titanium oxide, zinc oxide, barium sulfate, aluminum borate, potassium titanate or the like. Of these, carbon black is preferable.

Examples of a method for forming the resin-coated layer on the surface of a carrier core material include an immersion method of immersing a powder of a carrier core material in a solution for forming a coated layer; a spraying method of spraying a coated layer-forming solution on the surface of a carrier core material; a fluidized bed method of spraying a coated layer-forming solution on a carrier core material in a state of being floated by flowing air; a kneader-coater method of mixing a carrier core material and a coated layer-forming solution in a kneader-coater and then removing a solvent; and a powder coating method of particulating a coating resin, mixing it with a carrier core material in a kneader-coater at a temperature of a melting temperature of the coat resin or higher and after cooling, coating the mixture. In particular, a kneader-coater method or a powder coating method is preferable.

For the manufacture of the carrier, a heating type kneader, a heating type Henschel mixer, a UM mixer or the like may be sued, and depending on the amount of the coating resin, a heating type fluidized rolling bed, a heating type kiln or the like may also be used.

An average film thickness of the resin-coated layer formed by the foregoing method is usually in the range of from 0.1 μm to 10 μm, and more suitably from 0.2 μm to 5 μm.

The core material which is used for the carrier (carrier core material) is not particularly limited, and examples thereof include a magnetic metal such as iron, steel, nickel and cobalt; a magnetic oxide such as ferrite and magnetite; and a glass bead. Particularly, in the case of using a magnetic brush method, a magnetic carrier is preferable. In general, a number average particle size of the carrier core material is preferably from 10 μm to 100 μm, and more preferably from 20 μm to 80 μm.

A mixing ratio of the orange toner of the invention to the carrier in the two-component developer is not particularly limited, and it may be properly chosen depending upon the purpose. However, the mixing ratio of the toner to the carrier is preferably in the range of from about 1/100 to about 30/100, and more preferably in the range of from about 3/100 to about 20/100 in terms of a mass ratio.

[Image Forming Apparatus, Toner Storage Container and Process Cartridge]

First of all, the image forming apparatus according to the present exemplary embodiment using the orange toner according to the present exemplary embodiment is described; the toner storage container according to the present exemplary embodiment which is mounted on the image forming apparatus is then mentioned; and the process cartridge is separately described. Each of the following image forming apparatus, toner storage container and process cartridge is merely an example, and it should not be construed that the invention is limited thereto.

<Image Forming Apparatus>

The image forming apparatus according to the present exemplary embodiment includes an electrostatic latent image holding member that holds an electrostatic latent image formed on the surface thereof; a charging unit that charges the surface of the electrostatic latent image holding member; an electrostatic latent image forming unit that forms an electrostatic latent image on the charged surface of the electrostatic latent image holding member; a toner forming unit that stores the orange developer according to the present exemplary embodiment and supplying the toner to an electrostatic latent image formed on the surface of the electrostatic latent image holding member to form a toner image; a transfer unit that transfers the toner image onto a recording medium; and a fixing unit that fixes a transfer image transferred onto the recording medium.

In the present exemplary embodiment, a material of an intermediate transfer system for undergoing transfer via an intermediate transfer member is exemplified as the transfer unit, and it includes a primary transfer unit for primarily transferring a developed toner image onto the intermediate transfer member and a secondary transfer unit for secondarily transferring the toner image transferred onto the intermediate transfer member onto a recording material. Furthermore, the image forming apparatus according to the present exemplary embodiment includes a cleaning unit for removing the toner remaining on the surface of the electrostatic latent image holding member after the transfer by the primary transfer unit.

A diagrammatic configuration view showing an example of the image forming apparatus according to the present exemplary embodiment is shown in FIG. 1. An image forming apparatus 200 is configured to include an electrostatic latent image holding member 201, a charger 202 that is a charging unit, an image writing device 203 that is a latent image forming unit, a rotary developing device 204 that is a developing unit, a primary transfer roll 205 that is a primary transfer unit (transfer unit), a cleaning blade 206 that is a cleaning unit, an intermediate transfer material 207 that is an intermediate transfer member for transferring superimposed toner images of plural colors onto a recording paper (recording medium) P, three support rolls 208, 209 and 210 for tensioning and supporting the intermediate transfer material 207 together with the primary transfer roll 205, a secondary transfer roll 211 that is a secondary transfer unit (transfer unit), a conveying belt 212 for conveying the recording paper P after the secondary transfer, a fixing device (fixing unit) 215 for holding the recording paper P having been conveyed by the conveying belt 212 between two heating roll 213 and pressure rolls 214 and fixing toner images by heat and pressure, and so on.

The electrostatic latent image holding member 201 is formed in a drum shape as a whole and has a photosensitive layer on the outer circumferential surface (drum surface). This electrostatic latent image holding member 201 is provided rotatably in an arrow C direction in FIG. 1. The charger 202 uniformly charges the surface of the electrostatic latent image holding member 201. The image writing device 203 irradiates imagewise light X on the electrostatic latent image holding member 201 that is uniformly charged by the charger 202, thereby forming an electrostatic latent image.

The rotary developing device 204 has five developing devices 204Y, 204M, 204C, 204K and 204R storing toners for yellow, magenta, cyan, black and orange colors, respectively. In the present device, since a toner is used in the developer for forming an image, a yellow toner is stored in the developing device 204Y, a magenta toner is stored in the developing device 204M, a cyan toner is stored in the developing device 204C, a black toner is stored in the developing device 204K, and a red toner is stored in the developing device 204R. In the present exemplary embodiment, the orange toner according to the present exemplary embodiment is used as the red toner that is stored in the developing device 204R.

This rotary developing device 204 is driven to rotate such that the foregoing five developing devices 204R, 204Y, 204M, 204C and 204K sequentially come close to and oppose the electrostatic latent image holding member 201, whereby the toners are transferred onto the electrostatic latent images corresponding to the respective colors to form toner images.

Here, according to the image required, the developing devices other than the developing device 204R in the rotary developing device 204 may be partially removed. For example, the rotary developing device may include four developing devices, that is, a developing device 204Y, a developing device 204M, a developing device 204C and a developing device 204R. Also, the developing device may be changed to a developing device storing a developer of the desired color such as blue and green.

The primary transfer roll 205 transfers the toner image formed on the surface of the electrostatic latent image holding member 201 onto the outer circumferential surface of the endless belt-like intermediate transfer material 207 (primary transfer) while keeping the intermediate transfer material 207 to be held between the primary transfer roll 205 and the electrostatic latent image holding member 201. The cleaning blade 206 cleans (removes) the toner and the like remaining on the surface of the electrostatic latent image holding member 201 after the transfer. The intermediate transfer material 207 allows its inner circumferential surface to be tensioned by a plurality of the support rolls 208, 209 and 210 and the primary transfer roll 205 and is thereby supported orbitably in an arrow D direction and in the reverse direction. The secondary transfer roll 211 transfers the toner image transferred onto the outer circumferential surface of the intermediate transfer material 207, onto the recording paper P (secondary transfer) while keeping the recording paper (recording medium) P conveyed in an arrow E direction by a paper conveying unit (not shown) to be held between the secondary transfer roll 205 and the support roll 210.

The image forming apparatus 200 is a device sequentially forming toner images on the surface of the electrostatic latent image holding member 201 and transferring the toner images in a superposed manner onto the outer circumferential surface of the intermediate transfer material 207, and it operates as follows. That is, first of all, the electrostatic latent image holding member 201 is driven to rotate, and after the surface of the electrostatic latent image holding member 201 is uniformly charged by the charger 202 (charging step), imagewise light is irradiated on the electrostatic latent image holding member 201 by the image writing device 203 to form an electrostatic latent image (latent image forming step).

This electrostatic latent image is developed, for example, by the developing device 204R for red color (developing step), and the toner image formed is transferred onto the outer circumferential surface of the intermediate transfer material 207 by the primary transfer roll 205 (primary transfer step). At that time, the orange toner and the like remaining on the surface of the electrostatic latent image holding member 201 without being transferred onto the intermediate transfer material 207 are cleaned by the cleaning blade 206.

Also, the intermediate transfer material 207 having a toner image of orange color formed on the outer circumferential surface thereof once moves in orbit to the direction reverse to the arrow D direction while holding the toner image of orange color on its outer circumferential surface (at that time, the electrostatic latent image holding member 201 and the intermediate transfer material 207 are configured to alienate from each other) and prepares at the position where the next toner image of, for example, yellow color is transferred and stacked on the toner image of orange color.

Subsequently, charging by the charger 202, irradiation of imagewise light by the image writing device 203, formation of a toner image by each of the developing devices 204Y, 204M, 204C and 204K, and transfer of the toner image onto the circumferential surface of the intermediately transfer material 207 are sequentially repeated for respective toners of yellow, magenta, cyan and black.

In the present exemplary embodiment, for example, in the case of forming a red image, a yellow toner image formed on the electrostatic latent image holding member 201 by the developing device 204Y is transferred as disposed in the primary transfer step onto a red toner image formed on the intermediate transfer material 207 through the developing step and the primary transfer step, and a magenta toner image formed on the electrostatic latent image holding member 201 by the developing device 204M is then transferred as disposed in the primary transfer step onto the yellow toner image.

When the transfer of three color toner images onto the outer circumferential surface of the intermediate transfer material 207 is completed in this way, the toner images are transferred en bloc onto the recording paper P by the secondary transfer roll 211 (secondary transfer step). There is thus obtained a recorded image resulting from stacking of a magenta toner image, a yellow toner image and an orange toner image in this order from the image forming surface on the image forming surface of the recording paper P. The toner images transferred onto the surface of the recording paper P by the secondary transfer roll 211 are then heated and fixed by the fixing device 215 for fixing the transferred toner image (fixing step).

The charging unit, electrostatic latent image holding member, electrostatic latent image forming unit, toner image forming unit, transfer unit, intermediate transfer member, cleaning unit, fixing unit and recording medium in the image forming apparatus 200 of FIG. 1 are hereunder described.

(Charging Unit)

As for the charger 202 that is a charging unit, for example, a charger such as corotron is used, but a conductive or semiconductive charging roll may be used. In a contact type charger using a conductive or semiconductive charging roll, a direct current or a direct current superposed on an alternating current may be impressed to the electrostatic latent image holding member 201. The surface of the electrostatic latent image holding member 201 is charged by, for example, the charger 202 by generating a discharge in a microspace near the contact part with the electrostatic image holding member 201.

Usually, the surface of the electrostatic latent image holding member 201 is charged to from −300 V to −1,000 V by the charging unit. Also, the foregoing conductive or semiconductive charging roll may have a single-layer structure or a multiple structure. Furthermore, a mechanism of cleaning the surface of the charging roll may be provided.

(Electrostatic Latent Image Holding Member)

The electrostatic latent image holding member 201 has a function of allowing a latent image (electrostatic charge image) to be formed thereon. The electrostatic latent image holding member 201 is suitably an electrophotographic photoreceptor. The electrostatic latent image holding member 201 has a photosensitive layer including an organic photosensitive layer and the like on the outer circumferential surface of a cylindrical conductive substrate. In general, in this photosensitive layer, a subbing layer is formed on the surface of the substrate, if desired, and furthermore, a charge generating layer containing a chare generating substance and, a charge transport layer containing a charge transport substance are formed in this order. The order of stacking the chare generating layer and the charge transport layer may be reversed.

This is a laminate type photoreceptor where a charge generating substance and a charge transport substance are incorporated into separate layers (a charge generating layer and a charge transport layer), but the electrostatic latent image holding member 201 may be a single-layer photoreceptor containing both a charge generating substance and a charge transport substance in the same layer. A laminate type photoreceptor is preferable. Also, the photoreceptor may have an interlayer between the subbing layer and the photosensitive layer. Also, the present exemplary embodiment is not limited to an organic photosensitive layer, but a different kind of photosensitive layer, such as amorphous silicon photosensitive film, may also be used.

(Electrostatic Latent Image Forming Unit)

The image writing device 203 that is an electrostatic latent image forming unit is not particularly limited, and examples thereof include an optical instrument capable of irradiating light to expose a desired image on the surface of the electrostatic latent image holding member by using a light source such as semiconductor laser light, LED light and liquid crystal shutter light.

(Toner Image Forming Unit)

The toner image forming unit has a function of developing the latent image formed on the electrostatic latent image holding member with a toner image forming agent containing a toner to form a toner image. Such a toner image forming unit is not particularly limited so far as it has the foregoing function, and it may be properly chosen depending upon the purpose. Examples thereof include a known developing device having a function of attaching an electrostatic image developing toner to the electrostatic latent image holding member 201 by using a brush, roller or the like. On the occasion of development, a direct current voltage is usually used for the electrostatic latent image holding member 201, and it may also be used by superposing an alternating current voltage thereon.

(Transfer Unit)

The transfer unit (that refers to both the primary transfer unit and the secondary transfer unit in the present exemplary embodiment) may be, for example, a unit of providing an electric charge with a polarity opposite to that of the toner image from the back side of the recording medium and transferring the toner image to the surface of the recording medium by an electrostatic force, or a unit including a transfer roll using a conductive or semiconductive roll or the like and a transfer roll pressing device, which are brought into direct contact with the back surface of the recording medium to transfer the toner image.

For the transfer roll, as a transfer current to be imparted to the electrostatic latent image holding member, a direct current or a direct current superposed with an alternating current may be impressed. As for the transfer roll, various conditions and specifications may be properly set according to the width of the image region to be charged, the shape of the transfer charger, the opening width, the process speed (circumferential velocity) and the like. In order to achieve cost reduction, a single-layer foam roll or the like is suitably used as the transfer roll.

(Intermediate Transfer Member)

As the intermediate transfer member, a known intermediate transfer member may be used. Examples of a material which is used for the intermediate transfer member include a polycarbonate resin (PC), polyvinylidene fluoride (PVDF), a polyalkylene phthalate, and a blend material such as PC/polyalkylene terephthalate (PAT), ethylene tetrafluoroethylene copolymer (ETFE)/PC, ETFE/PAT and PC/PAT. In view of mechanical strength, an intermediate transfer belt using a thermosetting polyimide resin is preferable.

(Cleaning Unit)

As for the cleaning unit, a cleaning unit employing a blade cleaning system, a brush cleaning system or a roll cleaning system may be properly chosen so far as it cleans the residual toner on the electrostatic latent image holding member. Above all, use of a cleaning blade is preferable. Also, examples of a material of the cleaning blade include a urethane rubber, a neoprene rubber and a silicone rubber. Of these, it is especially preferable to use a polyurethane elastic material because of its excellent abrasion resistance.

However, in the case of using a toner with high transfer efficiency, an exemplary embodiment not using a cleaning unit may be employed.

(Fixing Unit)

The fixing unit (fixing device) is a unit of fixing the toner image transferred onto the recording medium by heating, pressurization, heating and pressurization or the like. Examples thereof include, in addition to a two-roll system as in the present exemplary embodiment, a belt-roll nip system in which the heating side or pressurization side is in a belt form, and the other is in a roll form; and a two-belt system in which both the heating side and the pressurization side are in a belt form. Examples of the belt include, in addition to a system of tensioning the belt by plural rolls, a free-belt system using the belt without being tensioned. In the invention, the fixing device of any system may be used.

(Recording Medium)

Examples of the recording medium (recording paper) on which a final recorded image is formed by transferring the toner image thereonto include plain paper and an OHP sheet, which are used for a copier, a printer or the like of the electrophotographic system. For more enhancing the smoothness of the image surface after fixing, the surface of the recording medium is preferably as smooth as possible, and for example, coated paper obtained by coating the surface of plain paper with a resin or the like, art paper for printing or the like may be preferably used.

In the present exemplary embodiment, examples of the plain paper include those having a smoothness in the range of 15 seconds to 80 seconds as measured in conformity with JIS-P-8119 and a basis weight of 80 g/m$^2$ or less as measured in conformity with JIS-P-8124. Examples of the coated paper include those having a coated layer on one surface of a paper substrate and having a smoothness in the range of 150 seconds to 1,000 seconds.

While the image forming apparatus of the invention has been described in detail by reference to preferred exemplary embodiments, it should not be construed that the invention is limited to the foregoing exemplary embodiments. For example, in the foregoing exemplary embodiments, the device having a configuration in which a latent image of each of the colors is formed on the single electrostatic latent image holding member 201 by the rotary developing device 204 having developing devices corresponding to the number of colors and transferred onto the intermediate transfer material 207 each time is exemplified. However, an image forming apparatus that is generally called a tandem system, in which units of the respective colors having electrostatic latent image holding members, charging units, toner image forming units, cleaning units and so on corresponding to the number of colors are disposed parallel opposing to the intermediate transfer medium (which may not be physically linear), the toner images of the respective colors formed by the respective units are primarily transferred onto the intermediate transfer medium, sequentially stacked and then en bloc secondarily transferred onto the recording medium, may also be used.

Also, as for the image forming apparatus of the invention, in addition to the respective constituent elements described in the foregoing exemplary embodiments, various other constitutions which are conventionally known or unknown can be added. So far as the constitutions of the image forming apparatus of the invention are still provided even by adding the foregoing other constitutions, as a matter of course, such an exemplary embodiment also falls within the scope of the invention. For example, a discharging unit may be provided as a post step of the cleaning unit. The discharging unit is outlined in the section of "process cartridge".

Besides, those skilled in the art are able to properly modify the image forming apparatus of the invention according to the conventionally known knowledge. So far as the constitutions of the image forming apparatus of the invention are still provided even by such modification, as a matter of course, such an exemplary embodiment also falls within the scope of the invention.

<Toner Storage Container (Toner Cartridge)>

The toner storage container according to the present exemplary embodiment is a toner storage container that is detachable against an image forming apparatus including an electrostatic latent image holding member that holds an electrostatic latent image formed on the surface thereof, a toner image forming unit that develops an electrostatic latent image held on the surface of the electrostatic latent image holding member with a toner to form a toner image on the surface of the electrostatic latent image holding member and a transfer unit that transfers the toner image onto a recording medium; and which stores the orange toner of the invention for supplying it to the toner image forming unit. The toner storage container according to the present exemplary embodiment is generally called a "toner cartridge".

In the toner cartridge according to the present exemplary embodiment, it is preferable that the toner is filled in a content ranging from about 70% to about 95% of the volume of the inside of the cartridge or from 70% to 95% of the volume of the inside of the cartridge.

By allowing the filling amount of the toner to fall within this range, the aggregation of the toner hardly takes place even at the time of storing the cartridge.

That is, in the exemplary embodiment shown in FIG. 1, the toner storage container is a container that stores the orange toner according to the present exemplary embodiment for supplying it to the developing device 204R and is one obtained by storing the orange toner in an appropriate container (not shown). Though the shape or material of such a container is not particularly limited, the container is, in general, made of a plastic material such as polypropylene, polycarbonate and an ABS resin.

<Process Cartridge>

In the present exemplary embodiment, the "process cartridge" means an assembly of constituent elements, in which two or more of the constituent elements in the image forming apparatus are integrally provided and which is configured to be detachable against the image forming apparatus main body for the purposes of maintenance or repair, regular replacing of consumables and so on. In the present exemplary embodiment, among the constituent elements of the image forming apparatus, the electrostatic latent image holding member and the toner image forming unit are included, and other constituent elements are arbitrary.

Figure 2:
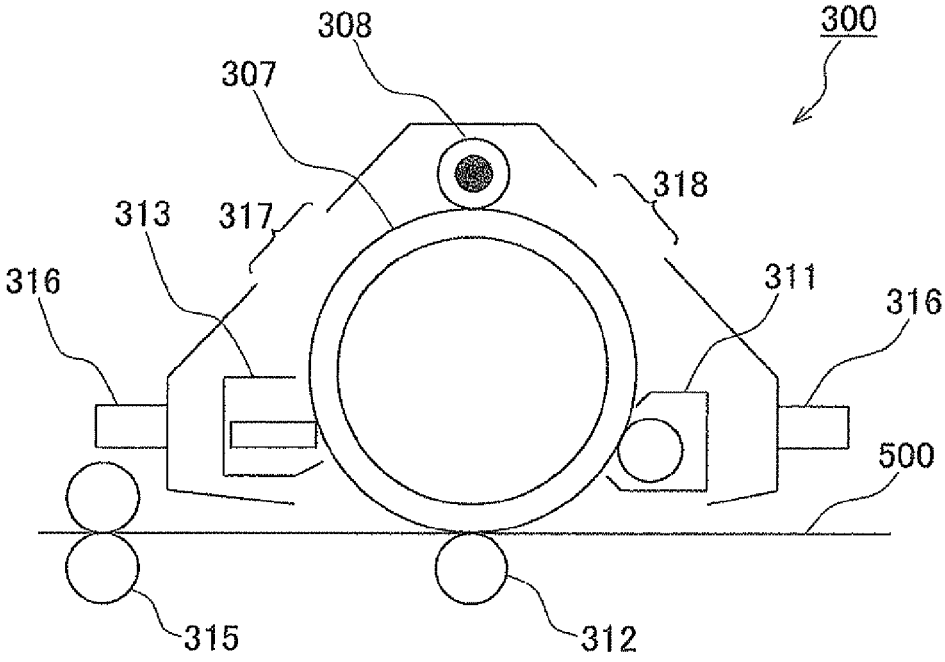
FIG. 2 is a schematic sectional view diagrammatically showing a basic configuration of a suitable example of a process cartridge of the invention, wherein 200 denotes Image forming apparatus; 201, 307 denote Electrostatic latent image holding member; 202, 308 denote Charger (charging unit); 203 denotes Image writing device (electrostatic latent image forming unit); 204 denotes Rotary developing device (toner image forming unit); 204Y, 204M, 204C, 204K, 204R denotes Developing device; 205 denotes Primary transfer roll (transfer unit); 206, 313 denote Cleaning blade; 207 denotes Intermediate transfer material; 208, 209, 210 denote Support roll; 211 denotes Secondary transfer roll (transfer unit); 212 denotes Conveying belt; 213 denotes Heating roll; 214 denotes Pressure roll; 215, 315 denote Fixing device; 300 denotes Process cartridge; 311 denotes Developing device; 312 denotes Transfer device; 316 denotes Mounting rail; 317 denotes Aperture; 318 denotes Aperture; P denotes Recording paper (recording medium).

FIG. 2 is a schematic sectional view diagrammatically showing a basic configuration of a suitable example of the process cartridge according to the present exemplary embodiment. A process cartridge 300 shown in FIG. 2 includes a charger (charging unit) 308, a developing device (toner image forming unit) 311 and a cleaning blade (cleaning unit) 313 as well as an electrostatic latent image holding member 307, is provided with an aperture 318 for exposure and an aperture 317 for discharge and exposure in a package and is further installed with a mounting rail 316, in which these material are integrated. The foregoing orange developer according to the present exemplary embodiment is stored in the developing device 311.

This process cartridge 300 is freely attachable to and detachable against the image forming apparatus main body including a transfer device 312, a fixing device 315 and other constituent elements that are not depicted, and constitutes the image forming apparatus together with the image forming apparatus main body.

The electrostatic latent image holding member 307, the charger (charging unit) 308 and the cleaning blade (cleaning unit) 313 are already described in the section of the exemplary embodiment of the image forming apparatus, and therefore, their details are omitted. The same materials can also be used in the process cartridge 300.

As for the transfer device 312 for transferring the toner image developed on the surface of the electrostatic latent image holding member 307 onto a recording paper 500, the contents described as the "transfer unit" summarizing both the primary transfer unit and the secondary transfer unit in the section of the exemplary embodiment of the image forming apparatus are also applicable to the process cartridge 300, and therefore, their details are omitted.

Examples of a non-illustrated discharger (optical discharger) include a tungsten lamp and LED, and examples of a light quality which is used for the optical discharging process include white lights such as a tungsten lamp and red lights such as LED. As for an irradiation light intensity in the optical discharging process, an output is usually set from several times to about 30 times the quantity of light exhibiting a half exposure sensitivity of the electrostatic latent image holding member.

In the process cartridge 300 according to the present exemplary embodiment, light from such an optical discharger is taken in from the aperture 317, whereby the surface of the electrostatic latent image holding member 307 is discharged.

Meanwhile, in the process cartridge 300 according to the present exemplary embodiment, the imagewise exposure light from a non-illustrated exposure device (exposure unit) is taken in from the aperture 318 and exposed on the surface of the electrostatic latent image holding member 307, thereby forming an electrostatic latent image.

The process cartridge 300 shown in FIG. 2 includes the charger 308, the cleaning device 313, the aperture 318 for exposure and the aperture 317 for erasing and exposure together with the electrostatic latent image holding member 307 and the developing device 311. In the present exemplary embodiment, these devices and the like can be selectively combined. In the process cartridge according to the present exemplary embodiment, the developed image forming units such as the electrostatic latent image holding member 307 and the developing device 311 are an essential constitution, and other constitutions are an arbitrary element.

Such a process cartridge according to the present exemplary embodiment is mounted in the above-described image forming apparatus (preferably an image forming apparatus of a so-called tandem system), and when it stores the orange developer bringing about excellent actions and effects on the basis of the invention, not only reproducibility of the color and image are obtainable, but the environmental dependency of an image density is suppressed.

EXAMPLES

The invention is hereunder described in more detail by referring to Examples and Comparative Examples, but it should not be construed that the invention is limited to the following Examples. All parts and percentages are on a mass basis unless otherwise indicated.

<Measurement Method of Ion Content>

A Na ion amount and an $NH_4$ ion amount in a toner are measured in the following manner.

First of all, 0.5 g of a toner subjective to the measurement (so-called toner particle but not the externally added toner) is weighed and dispersed in 100 g of ion-exchanged water to which 0.1 g of a nonionic surfactant (NONIPOL 10, manufactured by Sanyo Chemical Industries, Ltd.) corresponding to 20% relative to the toner solid content concentration is added, followed by dispersing using an ultrasonic disperser for 30 minutes in a thermostat controlled at 30±1° C.

The liquid after ultrasonic shaking is subjected to solid-liquid separation by means of suction filtration to remove a solid toner, and the obtained filtrate is measured by ion chromatography. In the ion chromatography, the analysis is performed using ICS-2000, manufactured by Nippon Dionex K.K. under the following condition.

Cation separation column: IonPac CS12A, manufactured by Nippon Dionex K.K.

Cation guard column: IonPac CG12A, manufactured by Nippon Dionex K.K.

Eluting solution: Methanesulfonic acid, 20 mM

Flow rate: 1 mL/min

Temperature: 35° C.

Detection method: Conductometric method (suppressor type)

<Measurement of Acid Value>

An avid value AV is measured by the neutralization titration method in conformity with JIS K0070. That is, an appropriate amount of a sample is aliquoted, to which are then added 160 mL of a solvent (acetone/toluene mixed liquid) and a few drops of an indicator (phenolphthalein solution), followed by thoroughly shaking and mixing on a water bath until the sample is completely dissolved. This is titrated with a 0.1 mol/L potassium ethanol solution, and a point at which a pale red color of the indicator continues for 30 seconds is defined as an end point.

When the acid value is defined as A, an amount of the sample is defined as S (g), the 0.1 mol/L potassium ethanol solution used for the titration is defined B (mL), and a factor of the 0.1 mol/L potassium ethanol solution is defined as f, the acid value is calculated according to the following expression.

$$A=(B\times f\times 5.611)/S$$

<Measurement Method of Glass Transition Temperature and Melting Temperature>

A glass transition temperature and a melting temperature are measured by means of differential scanning calorimetry in conformity with ASTM D3418-8.

<Measurement of Weight Average Molecular Weight (Mw)>

As for a weight average molecular weight (Mw) (as reduced into polystyrene) of a polyester resin, HLC-8120GPC, SC-8020 apparatus, manufactured by Tosoh Corporation is used as a GPC apparatus; TSK gel, Super HM-H (6.0 mm ID×15 cm×2), manufactured by Tosoh Corporation is used as a column; and THF (tetrahydrofuran) for chromatography, manufactured by Wako Pure Chemical Industries, Ltd. is used as an eluting solution. As for the experimental condition, a sample concentration is 0.5%, a flow rate is 0.6 mL/min, a sample injection amount is 10 μL, and a measurement temperature is 40° C. A calibration curve is prepared from 10 samples of A-500, F-1, F-10, F-80, F-380, A-2500, F-4, F-40, F-128 and F-700. Also, a data collection interval in the sample analysis is set to 300 ms.

<Calculation of Shape Factor SF1>

The measurement of a shape factor of a toner is performed using FPIA-3000, manufactured by Sysmex Corporation. A toner dispersion liquid for the measurement is prepared as follows. First of all, 30 mL of ion-exchanged water is charged in a 100-mL beaker, and two drops of a surfactant (CONTAMINON, manufactured by Wako Pure Chemical Industries, Ltd.) as a dispersant are added dropwise thereto. 20 mg of the toner is put in this liquid and dispersed for 3 minutes by means of ultrasonic dispersion, thereby preparing a dispersion liquid.

As for the obtained toner dispersion liquid, 4,500 toner particles are measured using FPIA-3000, and the shape factor is calculated.

<Measurement Method of Toner Volume Average Particle Size>

A volume average particle size of the toner particle is measured using a Multisizer II (manufactured by Beckman Coulter Inc.) measurement apparatus. ISOTON-II (manufactured by Beckman Coulter Inc.) is used as an electrolytic solution.

<Measurement of Particle Size Distribution of Toner>

As for the measurement of a particle size distribution index of the toner, cumulative distribution of each of the volume and the number is drawn from the small diameter side with respect to the particle size range (channel) divided on the basis of the particle size distribution measured using the foregoing Multisizer II, and the particle size at 16% accumulation is defined as $D_{16v}$ by volume and $D_{16p}$ by number, the particle size at 50% accumulation is defined as $D_{50v}$ by volume and $D_{50p}$ by number, and the particle size at 84% accumulation is defined as $D_{84v}$ by volume and $D_{84p}$ by number.

By using these measured values, a volume average particle size distribution index ($GSD_v$) is calculated from $(D_{84v}/D_{16v})^{1/2}$; a number average particle size distribution index ($GSD_p$) is calculated from $(D_{84p}/D_{16p})^{1/2}$; and a lower number average particle size distribution index (lower $GSD_p$) is calculated from $(D_{50p}/D_{16p})^{1/2}$.

<Preparation of Coloring Agent Dispersion Liquid (OR1)>

- Orange pigment (Novoperm Red HPG (C.I. Pigment Orange 38), manufactured by Clariant (Japan) K.K.): 200 parts by mass
- Anionic surfactant (Neogen SC, manufactured by Dai-Ichi Kogyo Seiyaku Co., Ltd.): 33 parts by mass (active ingredient: 60% by mass; 10% by mass relative to the coloring agent)
- Ion-exchange water: 750 parts by mass In a stainless steel container having a size such that at charge of all of the foregoing components, a height of the liquid level is about ⅓ of a height of the container, 280 parts by mass of ion-exchanged water and 33 parts by mass of the anionic surfactant are charged to thoroughly dissolve the surfactant therein; the whole of the orange pigment is charged; and the mixture is stirred using a stirrer until a non-wetted pigment disappears, and simultaneously, the mixture is thoroughly degassed.

After degassing, the remaining ion-exchanged water is added, the mixture is dispersed at 5,000 rpm for 10 minutes using a homogenizer (ULTRA TURRAX 150, manufactured by IKA Japan K.K.) and then degassed for twenty-four hours while stirring using a stirrer. After degassing, the resultant is again dispersed at 6,000 rpm for 10 minutes using the homogenizer and then degassed for twenty-four hours while stirring using the stirrer. Subsequently, the dispersion liquid is dispersed at a pressure of 240 MPa using a high-pressure counter collision disperser, MULTIMIZER (HJP30006, manufactured by Sugino Machine Limited). The dispersion is performed in a number corresponding to 25 passes as converted from a total charge amount and a throughput of the device.

The obtained dispersion liquid is allowed to stand for 72 hours to remove a precipitate, and ion-exchanged water is added, thereby adjusting a solid content concentration to 15% by mass. There is thus obtained a coloring agent dispersion liquid (OR1). Particles in this coloring agent dispersion liquid have a volume average particle size $D_{50v}$ is 155 nm. As for the volume average particle size $D_{50v}$, an average value of the measured values of three measurements excluding a maximum value and a minimum value out of five measurements by Microtrac is used.

<Preparation of Release Agent Dispersion Liquid (W1)>

- Hydrocarbon based wax (a trade name: FNP0090, manufactured by Nippon Seiro Co., Ltd., melting temperature Tw=90.2° C.): 270 parts by mass
- Anionic surfactant (Neogen RK, manufactured by Dai-Ichi Kogyo Seiyaku Co., Ltd., active ingredient: 60% by mass): 13.5 parts by mass (3.0% by mass as the active ingredient relative to the release agent)
- Ion-exchange water: 21.6 parts by mass The foregoing components are mixed; the release agent is dissolved at an internal liquid temperature of 120° C. using a pressure discharge type homogenizer (Gaulin Homogenizer, manufactured by Gaulin, Inc.); and thereafter, the solution is dispersed at a dispersing pressure of 5 MPa for 120 minutes and subsequently at 40 MPa for 360 minutes, followed by cooling to obtain a release agent dispersion liquid (W1). Particles in this release agent dispersion liquid have a volume average particle size $D_{50v}$ is 225 nm. Thereafter, ion-exchanged water is added, thereby adjusting a solid content concentration to 20.0% by mass.

<Preparation of Release Agent Dispersion Liquid (W2)>

- Hydrocarbon based wax (a trade name: POLYWAX 725, manufactured by Toyo Petrolite Co., Ltd., melting temperature Tw=102° C.): 270 parts by mass
- Anionic surfactant (Neogen RK, manufactured by Dai-Ichi Kogyo Seiyaku Co., Ltd., active ingredient: 60% by mass): 13.5 parts by mass (3.0% by mass as the active ingredient relative to the release agent)
- Ion-exchange water: 21.6 parts by mass The foregoing components are mixed; the release agent is dissolved at an internal liquid temperature of 120° C. using a pressure discharge type homogenizer (Gaulin Homogenizer, manufactured by Gaulin, Inc.); and thereafter, the solution is dispersed at a dispersing pressure of 5 MPa for 120 minutes and subsequently at 40 MPa for 360 minutes, followed by cooling to obtain a release agent dispersion liquid (W2). Particles in this release agent dispersion liquid have a volume average particle size $D_{50v}$ is 240 nm. Thereafter, ion-exchanged water is added, thereby adjusting a solid content concentration to 20.0% by mass.

<Preparation of Release Agent Dispersion Liquid (W3)>

Hydrocarbon based wax (a trade name: HNP-5, manufactured by Nippon Seiro Co., Ltd., melting temperature Tw=62° C.): 270 parts by mass Anionic surfactant (Neogen RK, manufactured by Dai-Ichi Kogyo Seiyaku Co., Ltd., active ingredient: 60% by mass): 13.5 parts by mass (3.0% by mass as the active ingredient relative to the release agent)

Ion-exchange water: 21.6 parts by mass

The foregoing components are mixed; the release agent is dissolved at an internal liquid temperature of 120° C. using a pressure discharge type homogenizer (Gaulin Homogenizer, manufactured by Gaulin, Inc.); and thereafter, the solution is dispersed at a dispersing pressure of 5 MPa for 120 minutes and subsequently at 40 MPa for 360 minutes, followed by cooling to obtain a release agent dispersion liquid (W3). Particles in this release agent dispersion liquid have a volume average particle size $D_{50v}$ is 240 nm. Thereafter, ion-exchanged water is added, thereby adjusting a solid content concentration to 20.0% by mass.

<Synthesis of Amorphous Polyester Resin (A1)>

Bisphenol A ethylene oxide 2.2-moles adduct: 40 mol %

Bisphenol A propylene oxide 2.2-moles adduct: 60 mol %

Terephthalic acid: 47 mol %

Fumaric acid: 40 mol %

Dodecenyl succinic anhydride: 15 mol %

Trimellitic anhydride: 3 mol %

A reactor equipped with a stirrer, a thermometer, a condenser and a nitrogen gas-introducing tube is charged with the foregoing monomer components exclusive of fumaric acid and trimellitic anhydride, and tin dioctanoate in an amount of 0.25 parts by mass based on 100 parts by mass of a total sum of the foregoing monomer components. After allowing the mixture to react in a nitrogen gas stream at 235° C. for 6 hours, the temperature is decreased to 200° C., and the foregoing fumaric acid and trimellitic anhydride are charged, followed by allowing the mixture to react for one hour. The temperature is further increased to 220° C. over 4 hours, and the reaction mixture is polymerized under a pressure of 10 kPa until a desired molecular weight is obtained, thereby obtaining a pale yellow transparent amorphous polyester resin (A1).

The obtained amorphous polyester resin (A1) has a glass transition temperature Tg by DSC of 59° C., a mass average molecular weight Mw by GPC of 25,000, a number average molecular weight Mn by GPC of 7,000, a softening temperature by a flow tester of 107° C. and an acid value AV of 13 mg-KOH/g.

<Synthesis of Amorphous Polyester Resin (A2)>

Bisphenol A ethylene oxide 2.2-moles adduct: 65 mol %

Bisphenol A propylene oxide 2.2-moles adduct: 35 mol %

Terephthalic acid: 50 mol %

Fumaric acid: 45 mol %

Dodecenyl succinic anhydride: 3 mol %

Trimellitic anhydride: 2 mol %

The foregoing monomers are treated in the same operation as in the synthesis of the amorphous polyester resin (A1), thereby obtaining a pale yellow transparent amorphous polyester resin (A2). The obtained amorphous polyester resin (A2) has a glass transition temperature Tg by DSC of 58° C., a mass average molecular weight Mw by GPC of 22,000, a number average molecular weight Mn by GPC of 6,800, a softening temperature by a flow tester of 105° C. and an acid value AV of 14 mg-KOH/g.

<Synthesis of Amorphous Polyester Resin (A3)>

Bisphenol A ethylene oxide 2.2-moles adduct: 20 mol %

Bisphenol A propylene oxide 2.2-moles adduct: 80 mol %

Terephthalic acid: 44 mol %

Fumaric acid: 33 mol %

Dodecenyl succinic anhydride: 25 mol %

Trimellitic anhydride: 3 mol %

The foregoing monomers are treated in the same operation as in the synthesis of the amorphous polyester resin (A1), thereby obtaining a pale yellow transparent amorphous polyester resin (A3). The obtained amorphous polyester resin (A3) has a glass transition temperature Tg by DSC of 56° C., a mass average molecular weight Mw by GPC of 21,000, a number average molecular weight Mn by GPC of 6,500, a softening temperature by a flow tester of 104° C. and an acid value AV of 16 mg-KOH/g.

<Synthesis of Amorphous Polyester Resin (B1)>

Bisphenol A propylene oxide adduct (NEWPOL BP-2P, manufactured by Sanyo Chemical Industries, Ltd.): 80 mol %

Bisphenol A ethylene oxide adduct (NEWPOL BPE-20, manufactured by Sanyo Chemical Industries, Ltd.): 20 mol %

Terephthalic acid: 70 mol %

Cyclohexanedicarboxylic acid (reagent): 30 mol %

A reactor equipped with a stirrer, a thermometer, a condenser and a nitrogen gas-introducing tube is charged with the foregoing components, and after substituting the inside of the reactor with a dry nitrogen gas, tin dioctanoate is charged in an amount of 0.25 parts by mass based on 100 parts by mass of a total sum of the foregoing monomer components. After allowing the mixture to react with stirring in a nitrogen gas stream at about 180° C. for 6 hours, the temperature is further increased to about 220° C. over one hour; the reaction is continued with stirring for about 7.0 hours; the temperature is further increased to 235° C.; the inside of the reactor is evacuated to 10.0 mmHg; and the reaction is continued with stirring for about 2.0 hours under reduced pressure, thereby obtaining a pale yellow transparent amorphous polyester resin (B1).

The obtained amorphous polyester resin (B1) has a glass transition temperature Tg by DSC of 52.5° C., a mass average molecular weight Mw by GPC of 18,000, a number average molecular weight Mn by GPC of 6,300 and an acid value AV of 9.3 mg-KOH/g.

<Synthesis of Crystalline Polyester Resin (C1)>

Dodecanedioic acid: 50 mol %

1,9-Nonanediol: 50 mol %

A reactor equipped with a stirrer, a thermometer, a condenser and a nitrogen gas-introducing tube is charged with the foregoing components, and after substituting the inside of the reactor with a dry nitrogen gas, titanium tetrabutoxide (reagent) is charged in an amount of 0.25 parts by mass based on 100 parts by mass of a total sum of the foregoing monomer components. After allowing the mixture to react with stirring in a nitrogen gas stream at 170° C. for 3 hours, the temperature is further increased to 210° C. over one hour; the inside of the reactor is evacuated to 3 kPa; and the reaction is continued with stirring for 13 hours under reduced pressure, thereby obtaining a crystalline polyester resin (C1).

The obtained crystalline polyester resin (C1) has a melting temperature Tc by DSC of 73.6° C., a mass average molecular weight Mw by GPC of 25,000, a number average molecular weight Mn by GPC of 10,500 and an acid value AV of 10.1 mg-KOH/g.

<Synthesis of Crystalline Polyester Resin (C2)>

1,8-Octane dicarboxylic acid: 50 mol %

1,9-Nonanediol: 50 mol %

The foregoing monomers are treated in the same operation as in the synthesis of the crystalline polyester resin (C1), thereby obtaining a crystalline polyester resin (C2). The obtained crystalline polyester resin (C2) has a melting temperature Tc by DSC of 69.2° C., a mass average molecular weight Mw by GPC of 27,000, a number average molecular weight Mn by GPC of 11,000 and an acid value AV of 9.9 mg-KOH/g.

<Synthesis of Crystalline Polyester Resin (C3)>

Dodecanedioic acid: 50 mol %

1,6-Hexanediol: 50 mol %

The foregoing monomers are treated in the same operation as in the synthesis of the crystalline polyester resin (C1), thereby obtaining a crystalline polyester resin (C3). The obtained crystalline polyester resin (C3) has a melting temperature Tc by DSC of 68.8° C., a mass average molecular weight Mw by GPC of 32,000, a number average molecular weight Mn by GPC of 12,000 and an acid value AV of 9.8 mg-KOH/g.

Example 1

<Preparation of Amorphous Polyester Resin Particle Dispersion Liquid (PA1)>

A jacketed 3-L reactor equipped with a condenser, a thermometer, a water-dropping device and an anchor blade (BJ-30N, manufactured by Tokyo Rikakikai Co., Ltd.) is charged with a mixed solvent of 160 parts by mass of ethyl acetate and 100 parts by mass of isopropyl alcohol while keeping the reactor at 40° C. by a water circulating thermostat; 300 parts by mass of the foregoing amorphous polyester resin (A1) is charged; and the mixture is dissolved with stirring at 150 rpm using a three-one motor, thereby obtaining an oil phase. To this stirred oil phase, 14 parts by mass of a 10% by mass ammonia aqueous solution is added dropwise for a dropwise addition time of 5 minutes; and after mixing for 10 minutes, 900 parts by mass of ion-exchanged water is further added dropwise at a rate of 7 pails by mass per minutes to cause phase inversion, thereby obtaining an emulsion liquid.

Immediately thereafter, 800 parts by mass of the obtained emulsion liquid and 700 parts by mass of ion-exchanged water are charged in a 2-L eggplant type flask, which is then set in an evaporator equipped with a vacuum control unit via a trap ball (manufactured by Tokyo Rikakikai Co., Ltd.). The eggplant type flask is heated to 60° C. on an oil bath while rotating and evacuated to 7 kPa while paying attention such that bumping does not occur, thereby removing the solvent. At a point of time when the solvent recovery amount reaches 1,100 parts by mass, the pressure is returned to atmospheric pressure, and the eggplant type flask is cooled with water to obtain a dispersion liquid. The obtained dispersion liquid is free from a solvent odor. A volume average particle size $D_{50v}$ of the resin particles in this dispersion liquid is 130 nm. Thereafter, ion-exchanged water is added to adjust a solid content concentration to 20% by mass, and this is denoted as an amorphous polyester resin dispersion liquid (PA1).

<Preparation of Additional Amorphous Polymer Resin Particle Dispersion Liquid (PA1A)>

350 parts by mass of the foregoing amorphous polyester resin dispersion liquid (PA1) is charged in a 500-mL beaker; 1.5 parts by mass of an anionic surfactant (Dowfax 2A1, manufactured by The Dow Chemical Company) is added while stirring by a magnetic stirrer at such a rate that bubbles are not incorporated; and after stirring for 10 minutes, a pH is adjusted to 3.2 with 1.0% by mass nitric acid, thereby obtaining an additional amorphous polymer resin particle dispersion liquid (PA1A).

<Preparation of Crystalline Polyester Resin Dispersion Liquid (PC1)>

A jacketed 3-L reactor equipped with a condenser, a thermometer, a water-dropping device and an anchor blade (BJ-30N, manufactured by Tokyo Rikakikai Co., Ltd.) is charged with 300 parts by mass of the foregoing crystalline polyester resin (PC1), 160 parts by mass of methyl ethyl ketone (solvent) and 100 parts by mass of isopropyl alcohol (solvent), and the resin is dissolved upon mixing with stirring at 100 rpm while keeping the mixture at 70° C. by a water circulating thermostat (solution preparing step).

Thereafter, the rotation rate is changed to 150 rpm; the water circulating thermostat is set up at 66° C.; 17 parts by mass of a 10% by mass ammonia water (reagent) is charged over 10 minutes; and thereafter, ion-exchanged water kept warm at 66° C. is added dropwise in an amount of 900 parts by mass in total at a rate of 7 parts by mass per minute to cause phase inversion, thereby obtaining an emulsion liquid.

Immediately thereafter, 800 parts by mass of the obtained emulsion liquid and 700 parts by mass of ion-exchanged water are charged in a 2-L eggplant type flask, which is then set in an evaporator equipped with a vacuum control unit via a trap ball (manufactured by Tokyo Rikakikai Co., Ltd.). The eggplant type flask is heated to 60° C. on an oil bath while rotating and evacuated to 7 kPa while paying attention such that bumping does not occur, thereby removing the solvent. At a point of time when the solvent recovery amount reaches 1,100 parts by mass, the pressure is returned to atmospheric pressure, and the eggplant type flask is cooled with water to obtain a dispersion liquid. The obtained dispersion liquid is free from a solvent odor. A volume average particle size $D_{50v}$ of the resin particles in this dispersion liquid is 130 nm. Thereafter, ion-exchanged water is added to adjust a solid content concentration to 20% by mass, and this is denoted as a crystalline polyester resin dispersion liquid (PC1).

<Preparation of Aluminum Sulfate Aqueous Solution (SA)>

Aluminum sulfate powder (17% aluminum sulfate, manufactured by Asada Chemical Industry Co., Ltd.): 35 parts by mass Ion-exchanged water: 1,965 parts by mass The foregoing components are charged in a 2-L container and mixed with stirring until a precipitate varnishes at 30° C., thereby preparing an aluminum sulfate aqueous solution.

<Preparation of Orange Toner (TC1)>

Amorphous polyester resin dispersion liquid (PA1): 700 parts by mass

Coloring agent dispersion liquid (OR1): 128 parts by mass

Release agent dispersion liquid (W1): 128 parts by mass

Ion-exchanged water: 300 parts by mass

Anionic surfactant (Dowfax 2A1, manufactured by The Dow Chemical Company): 2.6 parts by mass The foregoing components are charged in a 3-L reactor equipped with a thermometer, a pH meter and a stirrer; 1.0% by mass nitric acid is added at a temperature of 25° C. to adjust a pH to 3.0; 130 parts by mass of the thus prepared aluminum sulfate aqueous solution (SA) is added while dispersing at 5,000 rpm by a homogenizer (ULTRA TURRAX T50, manufactured by IKA Japan K.K.); and the mixture is dispersed for 6 minutes.

Thereafter, a stirrer and a mantle heater are placed in the reactor; the temperature is increased at a rate of 0.2° C./min until it reaches to 40° C. and at a rate of 0.05° C./min after it exceeds 40° C., while adjusting a rotation rate of the stirrer such that the slurry is thoroughly stirred; and a particle size is measured at intervals of 10 minutes by Multisizer II (aperture diameter: 50 manufactured by Beckman Coulter Inc.), When the volume average particle size reaches 5.0 μm, the temperature is kept, and the whole of the additional amorphous polyester resin dispersion liquid (PA1A) is charged over 5 minutes.

After the additional amorphous polyester resin dispersion liquid (PA1A) is charged, the mixture is kept for 30 minutes, and the pH is then adjusted to 9.0 using a 1% by mass sodium hydroxide aqueous solution. Thereafter, the temperature is increased to 90° C. at a rate of 1° C./min while similarly adjusting the pH to 9.0 at intervals of 5° C., and the mixture is then kept at 90° C. As a result of observing the shape and surface properties of particles by an optical microscope and a scanning electron microscope (FE-SEM) at intervals of 15 minutes, coalescence of particles is confirmed after elapsing 2.0 hours. Thus, the container is cooled with water to 30° C. over 5 minutes.

The slurry after cooling is allowed to pass through a nylon mesh with an opening of 15 μm to remove a coarse powder, and nitric acid is added to the toner slurry having passed through the mesh to adjust the pH to 6.0, followed by filtering under reduced pressure by an aspirator. The toner remaining on the filter paper is pulverized finely as far as possible and thrown into ion-exchanged water in an amount of 10 times the toner amount at a temperature of 30° C.; after stirring and mixing for 30 minutes, the mixture is again filtered under reduced pressure by an aspirator; and a conductivity of the filtrate is measured. This operation is repeated until the conductivity of the filtrate reaches 10 μS/cm or less, and the toner is washed.

The washed toner is finely pulverized by a dry/wet granulator (Comil) and dried in vacuo for 36 hours in an oven at 35° C., thereby obtaining toner particles. To 100 parts by mass of the obtained toner particles, 1.0 part by mass of hydrophobic silica (RY50, manufactured by Nippon Aerosil Co., Ltd.) is added, followed by mixing and blending at 13,000 rpm for 30 seconds using a sample mill. Thereafter, the resultant is sieved using a vibrating screen with an opening of 45 μm to obtain an orange toner (TC1).

The obtained orange toner (TC1) has a volume average particle size $D_{50}$ of 6.0 μm and a shape factor SF1 of 0.960 (using FPIA-3000, manufactured by Sysmex Corporation). As a result of observing an SEM image of the toner, the toner has a smooth surface and is free from faults such as projection of the release agent and separation of the surface layer.

<Preparation of Resin-Coated Carrier (C)>

- Mn—Mg—Sr based ferrite particles (average particle size: 40 μm): 100 parts by mass
- Toluene: 14 parts by mass
- Cyclohexyl methacrylate/dimethylaminoethyl methacrylate copolymer (copolymerization weight ratio: 99/1, Mw: 80,000): 2.0 parts by mass
- Carbon black (VXC 72, manufactured by Cabot Corporation): 0.12 parts by mass The foregoing components exclusive of the ferrite particles and glass beads (ϕ1 mm, the same amount as in toluene) are stirred at 1,200 rpm for 30 minutes using a sand mill, manufactured by Kansai Paint Co., Ltd., thereby obtaining a solution for forming a resin-coated layer. Furthermore, this solution for forming a resin-coated layer and the ferrite particles are charged in a vacuum deaeration type kneader and evacuated, and the toluene is distilled off, followed by drying to prepare a resin-coated carrier (C).

<Preparation of Orange Developer (DOR1)>

To 500 parts by mass of the foregoing resin-coated carrier (C), 40 parts by mass of the foregoing orange toner (TC1) is added and blended for 20 minutes using a V-type blender, and an aggregate is removed using a vibrating screen with an opening of 212 μm, thereby preparing an orange developer (DOR1).

<Preparation of Replenishing Orange Developer (DOR1A)>

To 20 parts by mass of the foregoing resin-coated carrier (C), 100 parts by mass of the foregoing orange toner (TC1) is added and blended for 20 minutes using a V-type blender, and an aggregate is removed using a vibrating screen with an opening of 212 μm, thereby preparing a replenishing orange developer (DOR1A).

Example 2

<Preparation of Additional Amorphous Polyester Resin Particle Dispersion Liquid (PA1A)>

The same operation as in Example 1 is performed to obtain an additional amorphous polyester resin particle dispersion liquid (PA1A) of the same amount as in Example 1.

<Preparation of Orange Toner (TC2)>

- Crystalline polyester resin dispersion liquid (PC1): 63 parts by mass
- Amorphous polyester resin dispersion liquid (PA1): 637 parts by mass
- Coloring agent dispersion liquid (OR1): 128 parts by mass
- Release agent dispersion liquid (W1): 128 parts by mass
- Ion-exchanged water: 320 parts by mass
- Anionic surfactant (Dowfax 2A1, manufactured by The Dow Chemical Company): 2.7 parts by mass The foregoing components are charged in a 3-L reactor equipped with a thermometer, a pH meter and a stirrer; 1.0% by mass nitric acid is added at a temperature of 25° C. to adjust a pH to 3.0; 125 parts by mass of the above-prepared aluminum sulfate aqueous solution (SA) is added while dispersing at 5,000 rpm by a homogenizer (ULTRA TURRAX T50, manufactured by IKA Japan K.K.); and the mixture is dispersed for 6 minutes.

Thereafter, a stirrer and a mantle heater are placed in the reactor; the temperature is increased at a rate of 0.2° C./min until it reaches to 40° C. and at a rate of 0.05° C./min after it exceeds 40° C., while adjusting a rotation rate of the stirrer such that the slurry is thoroughly stirred; and a particle size is measured at intervals of 10 minutes by Multisizer II (aperture diameter: 50 μm, manufactured by Beckman Coulter Inc.). When the volume average particle size reaches 5.0 μm, the temperature is kept, and the whole of the additional amorphous polyester resin dispersion liquid (PA1A) is charged over 5 minutes.

After the additional amorphous polyester resin dispersion liquid (PA1A) is charged, the mixture is kept for 30 minutes, and the pH is then adjusted to 9.0 using a 1% by mass sodium hydroxide aqueous solution. Thereafter, the temperature is increased to 90° C. at a rate of 1° C./min while similarly adjusting the pH to 9.0 at intervals of 5° C., and the mixture is then kept at 90° C. As a result of observing the shape and surface properties of particles by an optical microscope and a scanning electron microscope (FE-SEM) at intervals of 15 minutes, coalescence of particles is confirmed after elapsing 1.0 hour. Thus, the container is cooled with water to 30° C. over 5 minutes.

The slurry after cooling is allowed to pass through a nylon mesh with an opening of 15 μm to remove a coarse powder, and nitric acid is added to the toner slurry having passed through the mesh to adjust the pH to 6.0, followed by filtering under reduced pressure by an aspirator. The toner remaining on the filter paper is pulverized finely as far as possible and thrown into ion-exchanged water in an amount of 10 times the toner amount at a temperature of 30° C.; after stirring and mixing for 30 minutes, the mixture is again filtered under reduced pressure by an aspirator; and a conductivity of the filtrate is measured. This operation is repeated until the conductivity of the filtrate reaches 10 μS/cm or less, and the toner is washed.

The washed toner is pulverized by a dry/wet granulator (Comil) and dried in vacuo for 36 hours in an oven at 35° C., thereby obtaining toner particles. To 100 parts by mass of the obtained toner particles, 1.0 part by mass of hydrophobic silica (RY50, manufactured by Nippon Aerosil Co., Ltd.) and 0.8 parts by mass of hydrophobic titanium oxide (T805, manufactured by Nippon Aerosil Co., Ltd.) are added, followed by mixing and blending at 13,000 rpm for 30 seconds using a sample mill. Thereafter, the resultant is sieved using a vibrating screen with an opening of 45 μm to obtain an orange toner (TC2).

The obtained orange toner (TC2) has a volume average particle size $D_{50v}$ of 6.0 μm and a shape factor SF1 of 0.960 (using FPIA-3000, manufactured by Sysmex Corporation). As a result of observing an SEM image of the toner, the toner has a smooth surface and is free from faults such as projection of the release agent and separation of the surface layer.

<Preparation of Orange Developer (DOR2)>

An orange developer (DOR2) is obtained in the same operation as in Example 1, except for replacing the orange toner (TC1) with the orange toner (TC2) in the section of <Preparation of orange developer (DOR1)> of Example 1.

<Preparation of Replenishing Orange Developer (DOR2A)>

A replenishing orange developer (DOR2A) is obtained in the same operation as in Example 1, except for replacing the orange toner (TC1) with the orange toner (TC2) in the section of <Preparation of replenishing orange developer (DOR1A)> of Example 1.

Example 3

<Preparation of Additional Amorphous Polyester Resin Particle Dispersion Liquid (PA1A)>

The same operation as in Example 1 is performed to obtain an additional amorphous polyester resin particle dispersion liquid (PA1A) of the same amount as in Example 1.

<Preparation of Orange Toner (TC3)>

- Crystalline polyester resin dispersion liquid (PC1): 63 parts by mass
- Amorphous polyester resin dispersion liquid (PA1): 637 parts by mass
- Coloring agent dispersion liquid (OR1): 128 parts by mass
- Release agent dispersion liquid (W1): 128 parts by mass
- Ion-exchanged water: 320 parts by mass
- Anionic surfactant (Dowfax 2A1, manufactured by The Dow Chemical Company): 2.7 parts by mass The foregoing components are charged in a 3-L reactor equipped with a thermometer, a pH meter and a stirrer; 1.0% by mass nitric acid is added at a temperature of 25° C. to adjust a pH to 3.8; 125 parts by mass of the above-prepared aluminum sulfate aqueous solution (SA) is added while dispersing at 5,000 rpm by a homogenizer (ULTRA TURRAX T50, manufactured by IKA Japan K.K.); and the mixture is dispersed for 6 minutes.

Thereafter, a stirrer and a mantle heater are placed in the reactor; the temperature is increased at a rate of 0.2° C./min until it reaches to 40° C. and at a rate of 0.05° C./min after it exceeds 40° C., while adjusting a rotation rate of the stirrer such that the slurry is thoroughly stirred; and a particle size is measured at intervals of 10 minutes by Multisizer II (aperture diameter: 50 μm, manufactured by Beckman Coulter Inc.). When the volume average particle size reaches 5.0 μm, the temperature is kept, and the whole of the additional amorphous polyester resin dispersion liquid (PA1A) is charged over 5 minutes.

After the additional amorphous polyester resin dispersion liquid (PA1A) is charged, the mixture is kept for 30 minutes, and the pH is then adjusted to 9.0 using a 1% by mass sodium hydroxide aqueous solution. Thereafter, the temperature is increased to 90° C. at a rate of 1° C./min while similarly adjusting the pH to 9.0 at intervals of 5° C., and the mixture is then kept at 90° C. As a result of observing the shape and surface properties of particles by an optical microscope and a scanning electron microscope (FE-SEM) at intervals of 15 minutes, coalescence of particles is confirmed after elapsing 1.0 hour. Thus, the container is cooled with water to 30° C. over 5 minutes.

The slurry after cooling is allowed to pass through a nylon mesh with an opening of 15 μm to remove a coarse powder, and the toner slurry having passed through the mesh is filtered under reduced pressure by an aspirator. The toner remaining on the filter paper is pulverized finely as far as possible and thrown into ion-exchanged water in an amount of 10 times the toner amount at a temperature of 30° C.; after stirring and mixing for 30 minutes, the mixture is again filtered under reduced pressure by an aspirator; and a conductivity of the filtrate is measured. This operation is repeated until the conductivity of the filtrate reaches 10 μS/cm or less, and the toner is washed.

The washed toner is finely pulverized by a dry/wet granulator (Comil), and the same operation as that described in Example 1 of JP-A-2007-199202 (drying of wet colored toner particles 1) is followed to obtain dry toner particles.

To 100 parts by mass of the obtained toner particles, 1.0 part by mass of hydrophobic silica (RY50, manufactured by Nippon Aerosil Co., Ltd.) and 0.8 parts by mass of hydrophobic titanium oxide (T805, manufactured by Nippon Aerosil Co., Ltd.) are added, followed by mixing and blending at 13,000 rpm for 30 seconds using a sample mill. Thereafter, the resultant is sieved using a vibrating screen with an opening of 45 μm to obtain an orange toner (TC3).

The obtained orange toner (TC3) has a volume average particle size $D_{50v}$ of 5.8 μm and a shape factor SF1 of 0.968 (using FPIA-3000, manufactured by Sysmex Corporation). As a result of observing an SEM image of the toner, the toner has a smooth surface and is free from faults such as projection of the release agent and separation of the surface layer.

<Preparation of Orange Developer (DOR3)>

An orange developer (DOR3) is obtained in the same operation as in Example 1, except for replacing the orange toner (TC1) with the orange toner (TC3) in the section of <Preparation of orange developer (DOR1)> of Example 1.

<Preparation of Replenishing Orange Developer (DOR3A)>

A replenishing orange developer (DOR3A) is obtained in the same operation as in Example 1, except for replacing the orange toner (TC1) with the orange toner (TC3) in the section of <Preparation of replenishing orange developer (DOR1A)> of Example 1.

Example 4

An orange toner (TC4), an orange developer (DOR4) and a replenishing orange developer (DOR4A) are obtained in the same operations as in Example 3, except that in Example 3, in the preparation of the orange toner (TC3), the use amount of the crystalline polyester resin dispersion liquid (PC1) is changed from 63 parts by mass to 10 parts by mass, and the use amount of the amorphous polyester resin dispersion liquid (PA1) is changed from 637 parts by mass to 677 parts by mass.

The obtained orange toner (TC4) has a volume average particle size $D_{50v}$ of 5.9 μm and a shape factor SF1 of 0.955 (using FPIA-3000, manufactured by Sysmex Corporation). As a result of observing an SEM image of the toner, the toner has a smooth surface and is free from faults such as projection of the release agent and separation of the surface layer.

Example 5

An orange toner (TC5), an orange developer (DOR5) and a replenishing orange developer (DORSA) are obtained in the same operations as in Example 3, except that in Example 3, in the preparation of the orange toner (TC3), the use amount of the crystalline polyester resin dispersion liquid (PC1) is changed from 63 parts by mass to 103 parts by mass, and the use amount of the amorphous polyester resin dispersion liquid (PA1) is changed from 637 parts by mass to 583 parts by mass.

The obtained orange toner (TC5) has a volume average particle size $D_{50v}$ of 6.0 μm and a shape factor SF1 of 0.974 (using FPIA-3000, manufactured by Sysmex Corporation). As a result of observing an SEM image of the toner, the toner has a smooth surface and is free from faults such as projection of the release agent and separation of the surface layer.

Example 6

An orange toner (TC6), an orange developer (DOR6) and a replenishing orange developer (DOR6A) are obtained in the same operations as in Example 3, except that in Example 3, the used release agent dispersion liquid (W1) is changed to the release agent dispersion liquid (W3).

The obtained orange toner (TC6) has a volume average particle size $D_{50v}$ of 5.7 μm and a shape factor SF1 of 0.970 (using FPIA-3000, manufactured by Sysmex Corporation). As a result of observing an SEM image of the toner, the toner has a smooth surface and is free from faults such as projection of the release agent and separation of the surface layer.

Example 7

An orange toner (TC7), an orange developer (DOR7) and a replenishing orange developer (DOR7A) are obtained in the same operations as in Example 3, except that in Example 3, the used release agent dispersion liquid (W1) is changed to the release agent dispersion liquid (W2).

The obtained orange toner (TC7) has a volume average particle size $D_{50v}$ of 5.8 μm and a shape factor SF1 of 0.962 (using FPIA-3000, manufactured by Sysmex Corporation). As a result of observing an SEM image of the toner, the toner has a smooth surface and is free from faults such as projection of the release agent and separation of the surface layer.

Example 8

<Preparation of Crystalline Polyester Resin Dispersion Liquid (PC1-2)>

A crystalline polyester resin dispersion liquid ($PC_{1-2}$) is obtained in the same operation as in Example 1, except that in the preparation of the crystalline polyester resin dispersion liquid (PC1) of Example 1, the amount of the 10% by mass ammonia water to be added is changed from 17 parts by mass to 20 parts by mass. The obtained dispersion liquid is free from a solvent odor. A volume average particle size $D_{50v}$ of the resin particles in this dispersion liquid is 110 nm. Thereafter, ion-exchanged water is added to adjust a solid content concentration to 20% by mass.

<Preparation of Orange Toner (TC8)>

An orange toner (TC8) is obtained in the same operation as in Example 3, except that in Example 3, not only the used crystalline polyester resin dispersion liquid (PC1) is changed to the crystalline polyester resin dispersion liquid (PC1-2), but after the additional amorphous polyester resin dispersion liquid (PA1A) is charged and kept for 30 minutes, the pH adjusted using a 1% by mass sodium hydroxide aqueous solution is changed from 9.0 to 9.2.

The obtained orange toner (TC8) has a volume average particle size $D_{50v}$ of 5.8 μm and a shape factor SP1 of 0.965 (using FPIA-3000, manufactured by Sysmex Corporation). As a result of observing an SEM image of the toner, the toner has a smooth surface and is free from faults such as projection of the release agent and separation of the surface layer.

<Preparation of Orange Developer (DOR8)>

An orange developer (DOR8) is obtained in the same operation as in Example 1, except for replacing the orange toner (TC1) with the orange toner (TC8) in the section of <Preparation of orange developer (DOR1)> of Example 1.

<Preparation of Replenishing Orange Developer (DOR8A)>

A replenishing orange developer (DORSA) is obtained in the same operation as in Example 1, except for replacing the orange toner (TC1) with the orange toner (TC8) in the section of <Preparation of replenishing orange developer (DOR1A)> of Example 1.

Example 9

An orange toner (TC9), an orange developer (DOR9) and a replenishing orange developer (DOR9A) are obtained in the same operations as in Example 2, except that in Example 2, in the preparation of the orange toner (TC2), the pH value to be adjusted prior to dispersing by the homogenizer is changed from 3.0 to 3.8; after the additional amorphous polyester resin dispersion liquid (PA1A) is charged and kept for 30 minutes, the pH adjusted using a 1% by mass sodium hydroxide aqueous solution is changed from 9.0 to 7.0; and 25 parts by mass of a wet type silica dispersion (SNOWTEX OS, solids content: 20% by mass, manufactured Nissan Chemical Industries, Ltd.) is added.

The obtained orange toner (TC9) has a volume average particle size $D_{50v}$ of 5.6 μm and a shape factor SF1 of 0.968 (using FPIA-3000, manufactured by Sysmex Corporation). As a result of observing an SEM image of the toner, the toner has a smooth surface and is free from faults such as projection of the release agent and separation of the surface layer.

Example 10

<Preparation of Amorphous Polyester Resin Particle Dispersion Liquid (PA1-2)>

An amorphous polyester resin particle dispersion liquid (PA1-2) is obtained in the same operation as in Example 1, except that in the preparation of the amorphous polyester resin particle dispersion liquid (PA1) of Example 1, the amount of the 10% by mass ammonia water to be added is changed from 14 parts by mass to 17 parts by mass. The obtained dispersion liquid is free from a solvent odor. A volume average particle size $D_{50v}$ of the resin particles in this dispersion liquid is 120 nm. Thereafter, ion-exchanged water is added to adjust a solid content concentration to 20% by mass.

<Preparation of Additional Amorphous Polyester Resin Particle Dispersion Liquid (PA1-2A)>

An additional amorphous polyester resin particle dispersion liquid (PA1-2A) is obtained in the same operation as in Example 1, except that in the preparation of the additional amorphous polyester resin particle dispersion liquid (PA1A) of Example 1, the amorphous polyester resin particle dispersion liquid (PA1) is changed to the amorphous polyester resin particle dispersion liquid (PA1-2).

<Preparation of Orange Toner (TC 10)>

Crystalline polyester resin dispersion liquid (PC1-2): 63 parts by mass

Amorphous polyester resin dispersion liquid (PA1-2): 637 parts by mass

Coloring agent dispersion liquid (OR1): 128 parts by mass

Release agent dispersion liquid (W1): 128 parts by mass

Ion-exchanged water: 320 parts by mass

Anionic surfactant (Dowfax 2A1, manufactured by The Dow Chemical Company): 2.7 parts by mass The foregoing components are charged in a 3-L reactor equipped with a thermometer, a pH meter and a stirrer; 1.0% by mass nitric acid is added at a temperature of 25° C. to adjust a pH to 4.8; 130 parts by mass of the above-prepared aluminum sulfate aqueous solution (SA) is added while dispersing at 5,000 rpm by a homogenizer (ULTRA TURRAX T50, manufactured by IKA Japan K.K.); and the mixture is dispersed for 6 minutes.

Thereafter, a stirrer and a mantle heater are placed in the reactor; the temperature is increased at a rate of 0.2° C./min until it reaches to 40° C. and at a rate of 0.05° C./min after it exceeds 40° C., while adjusting a rotation rate of the stirrer such that the slurry is thoroughly stirred; and a particle size is measured at intervals of 10 minutes by Multisizer II (aperture diameter: 50 μm, manufactured by Beckman Coulter Inc.). When the volume average particle size reaches 5.0 μm, the temperature is kept, and the whole of the additional amorphous polyester resin dispersion liquid (PA1-2A) is charged over 5 minutes.

After the additional amorphous polyester resin dispersion liquid (PA1-2A) is charged, the mixture is kept for 30 minutes, and the pH is then adjusted to 9.5 using a 1% by mass sodium hydroxide aqueous solution. Thereafter, the temperature is increased to 90° C. at a rate of 1° C./min while similarly adjusting the pH to 9.5 at intervals of 5° C., and the mixture is then kept at 90° C. As a result of observing the shape and surface properties of particles by an optical microscope and a scanning electron microscope (FE-SEM) at intervals of 15 minutes, coalescence of particles is confirmed after elapsing 1.0 hour. Thus, the container is cooled with water to 30° C. over 5 minutes.

The slurry after cooling is allowed to pass through a nylon mesh with an opening of 15 μm to remove a coarse powder, and the toner slurry having passed through the mesh is filtered under reduced pressure by an aspirator. The toner remaining on the filter paper is pulverized finely as far as possible and thrown into ion-exchanged water in an amount of 10 times the toner amount at a temperature of 30° C.; after stirring and mixing for 30 minutes, the mixture is again filtered under reduced pressure by an aspirator; and a conductivity of the filtrate is measured. This operation is repeated until the conductivity of the filtrate reaches 15 μS/cm or less, and the toner is washed.

The washed toner is finely pulverized by a dry/wet granulator (Comil), and the same operation as that described in Example 1 of JP-A-2007-199202 (drying of wet colored toner particles 1) is followed to obtain dry toner particles.

To 100 parts by mass of the obtained toner particles, 1.0 part by mass of hydrophobic silica (RY50, manufactured by Nippon Aerosil Co., Ltd.) and 0.8 parts by mass of hydrophobic titanium oxide (T805, manufactured by Nippon Aerosil Co., Ltd.) are added, followed by mixing and blending at 13,000 rpm for 30 seconds using a sample mill. Thereafter, the resultant is sieved using a vibrating screen with an opening of 45 μm to obtain an orange toner (TC 10).

The obtained orange toner (TC10) has a volume average particle size $D_{50v}$ of 5.8 μm and a shape factor SF1 of 0.972 (using FPIA-3000, manufactured by Sysmex Corporation). As a result of observing an SEM image of the toner, the toner has a smooth surface and is free from faults such as projection of the release agent and separation of the surface layer.

<Preparation of Orange Developer (DOR10)>

An orange developer (DOR10) is obtained in the same operation as in Example 1, except for replacing the orange toner (IC1) with the orange toner (TC10) in the section of <Preparation of orange developer (DOR1)> of Example 1.

<Preparation of Replenishing Orange Developer (DOR10A)>

A replenishing orange developer (DOR10A) is obtained in the same operation as in Example 1, except for replacing the orange toner (TC1) with the orange toner (TC10) in the section of <Preparation of replenishing orange developer (DOR1A)> of Example 1.

Example 11

Preparation of Master Batch (MBA 1)>

Amorphous polyester resin (A1): 80 parts by mass

Orange pigment (Noveoperm Red HFG (CI Pigment Orange 38), manufactured by Clariant (Japan) K.K.): 20 parts by mass The foregoing components are kneaded by a Banbury mixer to prepare a master batch (MBA1).

<Preparation of Orange Toner (TC11)>

Master batch (MBA 1): 33 parts by mass

Amorphous polyester resin (A1): 61 parts by mass

Hydrocarbon based wax (a trade name: FNP0090, manufactured by Nippon Seiro Co., Ltd., melting temperature Tw 90.2° C.): 6 parts by mass The foregoing components are kneaded by a Banbury mixer; the kneaded mixture is formed into a plate having a thickness of about 1 cm while cooling, which is then coarsely pulverized into a size of about 1 mm by a Fitz mill and subsequently finely pulverized so as to have a volume average particle size of 7 μm. The pulverized material is classified by an elbow jet, thereby obtaining a toner (TC11) having a particle size of 7.17μm.

<Preparation of Orange Developer (DOR11)>

An orange developer (DOR11) is obtained in the same operation as in Example 1, except for replacing the orange toner (TC1) with the orange toner (TC11) in the section of <Preparation of orange developer (DOR1)> of Example 1.

<Preparation of Replenishing Orange Developer (DOR11A)>

A replenishing orange developer (DOR11A) is obtained in the same operation as in Example 1, except for replacing the orange toner (TC1) with the orange toner (TC11) in the section of <Preparation of replenishing orange developer (DOR1A)> of Example 1.

Example 12

An amorphous polyester resin dispersion liquid (PA2) and an additional amorphous polyester resin dispersion liquid (PA2A) are obtained in the same operations as in Example 1, except for changing the amorphous polyester resin (A1) to the amorphous polyester resin (A2).

A crystalline polyester resin dispersion liquid (PC3) is obtained in the same operation as in Example 1, except for changing the crystalline polyester resin (C1) to the crystalline polyester resin (C3).

<Preparation of Orange Toner (TC 12)>

Crystalline polyester resin dispersion liquid (PC3): 41 parts by mass

Amorphous polyester resin dispersion liquid (PA2): 646 parts by mass

Coloring agent dispersion liquid (OR1): 128 parts by mass

Release agent dispersion liquid (W1): 128 parts by mass

Ion-exchanged water: 320 parts by mass

Anionic surfactant (Dowfax 2A1, manufactured by The Dow Chemical Company): 2.7 parts by mass An orange toner (TC12) is obtained in the same operation as in Example 3, except for replacing the additional amorphous polyester resin dispersion liquid (PA1A) with the additional amorphous polyester resin dispersion liquid (PA2A) in the section of <Preparation of orange toner (TC3)> of Example 3.

<Preparation of Orange Developer (DOR12)>

An orange developer (DOR12) is obtained in the same operation as in Example 1, except for replacing the orange toner (TC 1) with the orange toner (TC 12) in the section of <Preparation of orange developer (DOR1)> of Example 1.

<Preparation of Replenishing Orange Developer (DOR12A)>

A replenishing orange developer (DOR12A) is obtained in the same operation as in Example 1, except for replacing the orange toner (TC1) with the orange toner (TC12) in the section of <Preparation of replenishing orange developer (DOR1A)> of Example 1.

Example 13

An amorphous polyester resin dispersion liquid (PA3) is obtained in the same operation as in Example 1, except for changing the amorphous polyester resin (A1) to the amorphous polyester resin (A3).

An amorphous polyester resin dispersion liquid (PB 1) is obtained in the same operation as in Example 1, except for changing the amorphous polyester resin (A1) to the amorphous polyester resin (B1).

An additional amorphous polyester resin dispersion liquid (PAB31A) is obtained in the same operation as in Example 1, except for changing 350 parts by mass of the amorphous resin dispersion liquid (PA1) to 280 parts by mass of the amorphous polyester resin dispersion liquid (PA3) and 70 parts by mass of the amorphous polyester resin dispersion liquid (PB1).

A crystalline polyester resin dispersion liquid (PC2) is obtained in the same operation as in Example 1, except for changing the crystalline polyester resin (C1) to the crystalline polyester resin (C2).

<Preparation of Orange Toner (TC13)>

Crystalline polyester resin dispersion liquid (PC2): 62 parts by mass

Amorphous polyester resin dispersion liquid (PA3): 500 parts by mass

Amorphous polyester resin dispersion liquid (PB1): 120 parts by mass

Coloring agent dispersion liquid (OR1): 128 parts by mass

Release agent dispersion liquid (WI): 128 parts by mass

Ion-exchanged water: 320 parts by mass

Anionic surfactant (Dowfax 2A1, manufactured by The Dow Chemical Company): 2.7 parts by mass An orange toner (TC13) is obtained in the same operation as in Example 3, except for changing the additional amorphous polyester resin dispersion liquid (PA1A) to the additional amorphous polyester resin dispersion liquid (PAB31A) in the section of <Preparation of orange toner (TC3)> of Example 3.

<Preparation of Orange Developer (DOR13)>

An orange developer (DOR13) is obtained in the same operation as in Example 1, except for replacing the orange toner (TC1) with the orange toner (TC13) in the section of <Preparation of orange developer (DOR1)> of Example 1.

<Preparation of replenishing orange developer (DOR13A)>

A replenishing orange developer (DOR13A) is obtained in the same operation as in Example 1, except for replacing the orange toner (TC1) with the orange toner (TC13) in the section of <Preparation of replenishing orange developer (DOR1A)> of Example 1.

Comparative Example 1

<Preparation of Amorphous Polyester Resin Particle Dispersion Liquid (PB1)>

A dispersion liquid is obtained in the same operation as in Example 1, except for changing the used amorphous polyester resin (A1) to the amorphous polyester resin (B1) in the section of <Preparation of amorphous polyester resin particle dispersion liquid (PA1)> of Example 1, A volume average particle size $D_{50v}$ of the resin particles in this dispersion liquid is 145 nm. Thereafter, ion-exchanged water is added to adjust a solid content concentration to 20% by mass, and this is denoted as an amorphous polyester resin dispersion liquid (PB1).

<Preparation of Additional Amorphous Polymer Resin Particle Dispersion Liquid (PB1A)>

350 parts by mass of the foregoing amorphous polyester resin dispersion liquid (PB1) is charged in a 500-mL beaker; 1.5 parts by mass of an anionic surfactant (Dowfax 2A1, manufactured by The Dow Chemical Company) is added while stirring by a magnetic stirrer at such a rate that bubbles are not incorporated; and after stirring for 10 minutes, a pH is adjusted to 3.6 with 1.0% by mass nitric acid, thereby obtaining an additional amorphous polymer resin particle dispersion liquid (PB 1A).

<Preparation of Orange Toner (TCC1)>

An orange toner (TCC1) is obtained in the same operation as in Example 1, except that in the section of <Preparation of orange toner (TC1)> of Example 1, not only the amorphous polyester resin dispersion liquid (PA1) is changed to the amorphous polyester resin dispersion liquid (PB1), but the additional amorphous polyester resin dispersion liquid (PA1A) is changed to the additional amorphous polyester resin dispersion liquid (PB1A).

The obtained orange toner (TCC 1) has a volume average particle size $D_{50v}$ of 6.0 μm and a shape factor SF1 of 0.952 (using FPIA-3000, manufactured by Sysmex Corporation). As a result of observing an SEM image of the toner, though the toner is free from faults such as projection of the release agent and separation of the surface layer, small irregularities having a size of from 100 nm to 300 nm are observed on the toner surface.

<Preparation of Orange Developer (DORC1)>

An orange developer (DORC1) is obtained in the same operation as in Example 1, except for changing the orange toner (TC1) to the orange toner (TCC1) in the section of <Preparation of orange developer (DOR1)> of Example 1.

<Preparation of Replenishing Orange Developer (DORC1A)>

A replenishing orange developer (DORC1A) is obtained in the same operation as in Example 1, except for replacing the orange toner (TC1) with the orange toner (TCC1) in the section of <Preparation of replenishing orange developer (DOR1A)> of Example 1.

Comparative Example 2

<Preparation of Master Batch (MBA2)>

A master batch (MBA2) is obtained in the same operation as in Example 11, except for changing the amorphous polyester resin (A1) to the amorphous polyester resin (B1) in the section of <Preparation of master batch (MBA 1)> of Example 11.

<Preparation of Orange Toner (TCC2)>

An orange toner (TCC2) is obtained in the same operation as in Example 11, except that in the section of <Preparation of orange toner (TC11)> of Example 11, not only the master batch (MBA 1) is changed to the master batch (MBA2), but the amorphous polyester resin (A1) is changed to the amorphous polyester resin (B1).

<Preparation of Orange Developer (DORC2)>

An orange developer (DORC2) is obtained in the same operation as in Example 1, except for changing the orange toner (TC1) to the orange toner (TCC2) in the section of <Preparation of orange developer (DOR1)> of Example 1.

<Preparation of Replenishing Orange Developer (DORC2A)>

A replenishing orange developer (DORC2A) is obtained in the same operation as in Example 1, except for replacing the orange toner (TC1) with the orange toner (TCC2) in the section of <Preparation of replenishing orange developer (DOR1A)> of Example 1.

[Evaluation Tests]

As for the orange toners, orange developers and replenishing orange developers obtained in Examples 1 to 13 and Comparative Examples 1 and 2, the following evaluation tests are performed. The results are summarized and shown in the following Table 1.

<Evaluation of Color Gamut>

In an environmental chamber at a temperature of 25° C. and a humidity of 60%, after a main body, developing devices and toner cartridges of DocuCenter Color 400 CP, manufactured by Fuji Xerox Co., Ltd. are cleaned by thoroughly removing a developer and a toner having been previously set, the thus prepared developer is charged in a developing device, and the replenishing toners are charged in the respective toner cartridges. A magenta developing device is set in a position where the magenta developing device is originally set in DocuCenter Color 400 CP; a yellow developing device is set in a position where the yellow developing device is originally set; an orange developing device is set in a position where a cyan developing device is originally set; and a black developing device is set in a position where the black developing device is originally set, respectively. Three sheets of A3-size paper are allowed to pass therethrough without being developed, followed by allowing to stand for 48 hours as they are.

Subsequently, a developing toner amount of a 100% image of each single color on OK top coated paper is adjusted to 4.0 g/m$^2$; a secondary color image made of 100% of a yellow toner and 100% of a magenta toner and a single color image made of only 100% of an orange toner, each having a size of 5 cm×5 cm, are prepared; and the obtained image density and color gamut (L*a*b*) are measured. X-Rite 939 (aperture: 4 mm, manufactured by X-Rite) is used for the measurement; 10 places in the image surface are measured at random; and an average value is denoted as a density (Dr) and a color gamut (L*a*b*). A color saturation (C*) is calculated from the obtained color gamut (L*a*b*) according to the following expression.

$$C^*=(a^*\times a^*+b^*\times b^*)^{1/2}$$

The color saturation of the single color image made of only 100% of an orange toner and the color saturation of the secondary color image made of a yellow toner and a magenta toner are compared, and the color saturation is evaluated according to the following criteria.

A: The color saturation of the single color image is larger by 4 or more than that of the secondary color image.

B: The color saturation of the single color image is larger by 2 or more and less than 4 than that of the secondary color image.

C: The color saturation of the single color image is larger by 0 or more and less than 2 than that of the secondary color image.

D: The color saturate of the single color image is smaller than that of the secondary color image.

<Evaluation of Image Density at Low Humidity>

In a state where the evaluation of color gamut is finished, the developing toner amount is again adjusted to 4.0 g/m$^2$, and thereafter, the temperature and relative humidity are set at a temperature of 15° C. and a humidity of 15%, followed by allowing it to stand for 48 hours. After standing, three sheets of A3-size paper are allowed to pass therethrough without being developed, an image made of only 100% of an orange toner and having a size of 5 cm×5 cm is then prepared, and the obtained image density is measured. X-Rite 939 (aperture: 4 mm, manufactured by X-Rite) is used for the measurement; 10 places in the image surface are measured at random; and an average value is denoted as an image density (Dc).

An image density ratio (Dc/Dr) which is a ratio of the thus obtained image density (Dc) at a temperature of 15° C. and a humidity of 15% to an image density (Dr) at a temperature of 25° C. and a humidity of 60% is calculated, thereby evaluating a degree of lowering in the image density at a low humidity according to the following criteria. Here, the image density (Dr) at a temperature of 25° C. and a humidity of 60% is one obtained on the occasion of the foregoing evaluation of color gamut.

A: Dc/Dr is 0.97 or more and less than 1.03.

B: The case where Dc/Dr is 0.93 or more and less than 0.97, or the case where Dc/Dr is 1.03 or more and less than 1.07.

C: The case where Dc/Dr is 0.9 or more and less than 0.93, or the case where Dc/Dr is 1.07 or more and less than 1.10.

D: The case where Dc/Dr is less than 0.9, or the case where Dc/Dr is 1.10 or more.

TABLE 1

| | Example 1 | Example 2 | Example 3 | Example 4 | Example 5 | Example 6 | Example 7 | Example 8 | Example 9 |
|---|---|---|---|---|---|---|---|---|---|
| Orange pigment species | Orange 38 | Orange 38 | Orange 38 | Orange 38 | Orange 38 | Orange 38 | Orange 38 | Orange 38 | Orange 38 |

TABLE 1-continued

| | | | | | | | | | |
|---|---|---|---|---|---|---|---|---|---|
| Blending amount of pigment [% by mass] | 7 | 7 | 7 | 7 | 7 | 7 | 7 | 7 | 7 |
| Amorphous polyester resin | (A1) | (A1) | (A1) | (A1) | (A1) | (A1) | (A1) | (A1) | (A1) |
| Crystalline polyester resin | No | (C1) | (C1) | (C1) | (C1) | (C1) | (C1) | (C1) | (C1) |
| Melting temperature of crystalline polyester resin [° C.] | — | 73.6 | 73.6 | 73.6 | 73.6 | 73.6 | 73.6 | 73.6 | 73.6 |
| Amount of crystalline polyester resin [% by mass] | No | 6 | 6 | 1 | 10 | 6 | 6 | 6 | 6 |
| Wax dispersion liquid | (W1) | (W1) | (W1) | (W1) | (W1) | (W3) | (W2) | (W1) | (W1) |
| Melting temperature of wax [° C.] | 90 | 90 | 90 | 90 | 90 | 62 | 102 | 90 | 90 |
| Na ion amount [mg/L] | 0.15 | 0.16 | 0.14 | 0.15 | 0.13 | 0.15 | 0.14 | 0.19 | 0.04 |
| $NH_4$ ion amount [mg/L] | 0.03 | 0.07 | 0.35 | 0.28 | 0.4 | 0.33 | 0.38 | 0.48 | 0.05 |
| ($NH_4$ ion amount)/(Na ion amount) | 0.2 | 0.4 | 2.5 | 1.9 | 3.1 | 2.2 | 2.5 | 2.5 | 1.2 |
| Evaluation of color gamut (color saturation) | B | A | A | B | B | B | B | A | A |
| Evaluation of image density at low humidity (image density ratio) | C | C | A | A | A | A | A | A | B |

| | Example 10 | Example 11 | Example 12 | Example 13 | Comparative Example 1 | Comparative Example 2 |
|---|---|---|---|---|---|---|
| Orange pigment species | Orange 38 | Orange 38 | Orange 38 | Orange 38 | Orange 38 | Orange 38 |
| Blending amount of pigment [% by mass] | 7 | 7 | 7 | 7 | 7 | 7 |
| Amorphous polyester resin | (A1) | (A1) | (A2) | (A3)/(B1) = 80/20 | (B1) | (B1) |
| Crystalline polyester resin | (C1) | No | (C3) | (C2) | No | No |
| Melting temperature of crystalline polyester resin [° C.] | 73.6 | — | 68.8 | 69.2 | — | — |
| Amount of crystalline polyester resin [% by mass] | 6 | No | 4 | 6 | No | No |
| Wax dispersion liquid | (W1) | (W1) | (W1) | (W1) | (W1) | (W1) |
| Melting temperature of wax [° C.] | 90 | 90 | 90 | 90 | 90 | 90 |
| Na ion amount [mg/L] | 0.28 | — | 0.13 | 0.14 | 0.17 | — |
| $NH_4$ ion amount [mg/L] | 0.68 | — | 0.38 | 0.34 | 0.04 | — |
| ($NH_4$ ion amount)/(Na ion amount) | 2.4 | — | 2.9 | 2.4 | 0.23 | — |
| Evaluation of color gamut (color saturation) | A | C | A | B | D | D |
| Evaluation of image density at low humidity (image density ratio) | B | C | A | A | D | D |

In Table 1, the value of the amount of crystalline polyester resin is expressed as the amount of the crystalline polyester resin relative to the whole of the binder resin in terms of % by mass. Also, as for the Na ion amount and the $NH_4$ ion amount, values obtained by rounding to two decimal places are used. Also, as for the ($NH_4$ ion amount)/(Na ion amount) ratio, values obtained by rounding to one decimal places are used.

[Consideration of the Results]

The orange toners of the Examples are excellent in color saturation. Also, it is confirmed that as for the orange toners of the Examples, the lowering of the image density is suppressed even in a low-humidity environment, and the environmental dependency of the image density is suppressed.

What is claimed is:

1. An orange toner comprising a binder resin and a coloring agent, wherein the binder resin contains a polyester resin having a dodecenyl succinic acid structure;

the coloring agent contains C.I. Pigment Orange 38 in a content of from about 5% by mass to about 18% by mass relative to the whole mass of the toner; and the toner is satisfying the following formulae (a) to (c):

$$0.05\ \text{mg/L} \leq (\text{Na ion amount}) \leq 0.3\ \text{mg/L} \quad \text{(a)}$$

$$0.3\ \text{mg/L} \leq (NH_4\ \text{ion amount}) \leq 1.0\ \text{mg/L} \quad \text{(b)}$$

$$1.0 \leq (NH_4\ \text{ion amount})/(\text{Na ion amount}) \leq 5.0 \quad \text{(c)}$$

wherein each of Na ion amount and $NH_4$ ion amount is a value detected by weighing 0.5 g of the toner, adding the toner to 100 g of ion-exchanged water at 30±1° C. dispersing it for 30 minutes by an ultrasonic disperser, filtering the dispersion and then analyzing the filtrate by ion chromatography.

2. The orange toner according to claim 1, wherein the toner further contains a hydrocarbon based wax having a melting temperature of about 60° C. or higher and lower than 100° C.; and the binder resin contains a crystalline polyester resin in a content of from about 1% by mass to about 10% by mass in the binder resin component, and the melting temperature of the hydrocarbon based wax is higher than a melting temperature of the crystalline polyester resin.

3. A color toner set comprising a yellow toner containing C.I. Pigment Yellow 74; a magenta toner containing C.I. Pigment Red 238 or 269; and the orange toner according to claim 2.

4. An orange developer comprising the orange toner according to claim 2; and a carrier.

5. The orange toner according to claim 2, wherein the hydrocarbon based wax has a melting temperature of 80° C. to 95° C.

6. The orange toner according to claim 2, wherein the crystalline polyester resin is present in a content from about 2% by mass to about 8% by mass of the binder resin component.

7. The orange toner according to claim 1, wherein the toner is one prepared in an aqueous medium.

8. The orange toner according to claim 1, wherein a dispersion diameter of the coloring agent particles in the toner is in the range of from about 30 nm to about 300 nm.

9. The orange toner according to claim 1, wherein a content of the dodecenyl succinic acid structure is in the range of from about 3 mol % to about 30 mol % based on 100 mol % of the whole of acid-derived components of the polyester resin.

10. The orange toner according to claim 1, wherein a ratio of mol % of the dodecenyl succinic acid structure in the toner to the content of C.I. Pigment Orange 38 in the toner is in the range of from about 3/1 to about 1/12.

11. The orange toner according to claim 1, wherein a ratio of mol % of the dodecenyl succinic acid structure in the toner to the content of C.I. Pigment Orange 38 in the toner is in the range of from about 2/1 to about 1/9.

12. A color toner set comprising a yellow toner containing C.I. Pigment Yellow 74; a magenta toner containing C.I. Pigment Red 238 or 269; and the orange toner according to claim 1.

13. An orange developer comprising the orange toner according to claim 1; and a carrier.

* * * * *